US007619587B2

(12) United States Patent
Han et al.

(10) Patent No.: US 7,619,587 B2
(45) Date of Patent: Nov. 17, 2009

(54) PLASMA DISPLAY APPARATUS AND DRIVING METHOD OF THE SAME

(75) Inventors: Jung Gwan Han, Gumi-si (KR); Seongho Kang, Daegu (KR)

(73) Assignee: LG Electronics Inc., Seoul (KR)

( * ) Notice: Subject to any disclaimer, the term of this patent is extended or adjusted under 35 U.S.C. 154(b) by 603 days.

(21) Appl. No.: 11/411,965

(22) Filed: Apr. 27, 2006

(65) Prior Publication Data

US 2007/0126658 A1 Jun. 7, 2007

(30) Foreign Application Priority Data

Dec. 2, 2005 (KR) ..... 10-2005-0116881

(51) Int. Cl.
*G09G 3/28* (2006.01)

(52) U.S. Cl. ..... 345/60; 345/62; 345/63

(58) Field of Classification Search ..... 345/60, 345/62, 63

See application file for complete search history.

(56) References Cited

U.S. PATENT DOCUMENTS

| | | | | |
|---|---|---|---|---|
| 2003/0169215 | A1 | 9/2003 | Iwami | 345/60 |
| 2004/0135747 | A1 * | 7/2004 | Yoon | 345/60 |
| 2005/0083771 | A1 | 4/2005 | Kim et al. | 365/232 |
| 2006/0077131 | A1 * | 4/2006 | Jung | 345/63 |
| 2006/0158387 | A1 * | 7/2006 | Kim | 345/60 |

FOREIGN PATENT DOCUMENTS

| | | |
|---|---|---|
| EP | 1 315 140 | 5/2003 |
| EP | 1 736 956 | 12/2006 |
| EP | 1 785 976 | 5/2007 |
| JP | 2000-338930 | 12/2000 |

OTHER PUBLICATIONS

European Search Report dated Dec. 20, 2007.

* cited by examiner

*Primary Examiner*—Amare Mengistu
*Assistant Examiner*—Koosha Sharifi
(74) *Attorney, Agent, or Firm*—KED & Associates, LLP

(57) ABSTRACT

A plasma display apparatus for reducing heat generated in a data driver for supplying a driving voltage to an address electrode formed on a plasma display panel when driving the plasma display apparatus, and a driving method of the same are provided. The plasma display apparatus includes a plasma display panel including an address electrode and a driver. The driver supplies the first data pulse to the address electrode when a temperature of the plasma display panel or an ambient temperature of the plasma display panel is less than a first temperature. Further, the driver supplies the second data pulse different from the first data pulse to the address electrode when the temperature of the plasma display panel or the ambient temperature of the plasma display panel is equal to or more than the first temperature.

26 Claims, 30 Drawing Sheets

PLASMA DISPLAY APPARATUS AND DRIVING METHOD OF THE SAME

This application claims the benefit of Korean Patent Application No. 10-2005-0116881 filed Dec. 2, 2005, which is hereby incorporated by reference for all purposes as if fully set forth herein.

BACKGROUND OF THE INVENTION

1. Field of the Invention

This document relates to a plasma display apparatus, and more particularly, to a plasma display apparatus for reducing heat generated in a data driver for supplying a driving voltage to an address electrode formed on a plasma display panel when driving the plasma display apparatus, and a driving method of the same.

2. Description of the Background Art

Generally, a plasma display panel comprises a front panel and a rear panel. Barrier ribs formed between the front panel and the rear panel form discharge cells. Each of the discharge cells is filled with an inert gas containing a main discharge gas such as neon (Ne), helium (He) or a Ne—He gas mixture and a small amount of xenon (Xe) The plurality of discharge cells forms one pixel. For example, red, green and blue discharge cells form one pixel.

When the plasma display panel is discharged by a high frequency voltage, the inert gas generates vacuum ultraviolet rays and the vacuum ultraviolet rays excite phosphors formed between the barrier ribs. As a result, an image is displayed on the plasma display panel. Since the above-described plasma display panel can be manufactured to be thin and light, the plasma display panel has been considered as a next generation display apparatus.

A plurality of electrodes, for example, a scan electrode, a sustain electrode and an address electrode are formed on the plasma display panel. A predetermined driving voltage is supplied to the plurality of electrodes to generate a discharge, thereby displaying the image on the plasma display panel. A drive integrated circuit (IC) is connected to each of the plurality of electrodes for supplying the driving voltage to the plurality of electrodes.

For example, a data drive IC is connected to the address electrode of the plurality of electrodes and a scan drive IC is connected to the scan electrode.

A plasma display apparatus comprises the plasma display panel on which the plurality of electrodes are formed, and the drive ICs for supplying the predetermined driving voltage to the plurality of electrodes of the plasma display panel.

A structure of the plasma display apparatus comprising the related art data drive IC for supplying the predetermined driving voltage to the address electrode of the plasma display panel will be described with reference to FIG. 1.

FIG. 1 shows a structure of a plasma display apparatus comprising a related art data drive IC.

As shown in FIG. 1, the plasma display apparatus comprises top switches Qt1, Qt2 and Qt3 and bottom switches Qb1, Qb2 and Qb3 connected in series between a data voltage source (not shown) for supplying a data voltage Vd and a ground voltage source (not shown) for supplying a ground level voltage GND.

A plurality of address electrodes X are connected between the top switches Qt1, Qt2 and Qt3 and the bottom switches Qb1, Qb2 and Qb3.

Each of the top switches Qt1, Qt2 and Qt3 and each of the bottom switches Qb1, Qb2 and Qb3 form a data drive IC. In other words, the top switch Qt1 and the bottom switch Qb1 form a data drive IC 100. The data drive IC 100 is connected to an address electrode Xa of the plurality of address electrodes X.

In the same manner as the data drive IC 100, the data drive ICs 101 and 102 are connected to address electrodes Xb and Xc, respectively.

Although three data drive ICs are shown in FIG. 1, the number of the data drive ICs may be variably changed depending on the number of address electrodes X.

An operation of the plasma display apparatus will be described with reference to FIG. 2.

FIG. 2 shows an operation timing for explaining an operation of the related art plasma display apparatus.

As shown in FIG. 2, when the top switch Qt1 of the data drive IC 100 is turned on in an address period, the data voltage Vd from the data voltage source (not shown) is supplied to the address electrode Xa through the top switch Qt1. Thus, as shown in FIG. 2, a voltage of the address electrode Xa rises up to the data voltage Vd, and then is maintained at the data voltage Vd.

When the top switch Qt1 of the data drive IC 100 is turned off and the bottom switch Qb1 is turned on, a voltage of the address electrode Xa falls to the ground level voltage GND. That is, a data pulse of the data voltage Vd is supplied to the address electrode Xa by alternately operating the top switch Qt1 and the bottom switch Qb1.

Switching operations for supplying a data pulse of each of the data drive ICs 101 and 102 are the same as the data drive IC 100.

Heat of a relatively high temperature is generated in the switches of each of the data drive ICs shown in FIG. 1 in the related art plasma display apparatus operated as described above.

For example, suppose that the data voltage Vd supplied from the data voltage source is 60 V and resistance of each of the top switches Qt1, Qt2 and Qt3 is R.

When the data drive IC 100 supplies the data voltage Vd to the address electrode Xa, a current flowing in the top switch Qt1 and a power consumed in the top switch Qt1 are represented by the following Equation 1.

$$i=60\text{V}/R$$

$$W=i\times 60\text{V} \qquad \text{[Equation 1]}$$

In Equation 1, i denotes a current following in the top switch Qt1. W denotes a power consumed in the top switch Qt1.

As shown in the above Equation 1, when driving the data drive IC 100, the top switch Qt1 consumes a power corresponding to (i×60V). At this time, the heat is generated in the top switch Qt1 in proportion to the consumption power W. For example, supposing that a resistance of the top switch Qt1 is 30Ω, heat corresponding to a power of 120 W [(60/30)×60] is generated in the top switch Qt1.

Heat generated in each of the top switches Qt1, Qt2 and Qt3 is generated in each of the bottom switches Qb1, Qb2 and Qb3.

In particular, when image data is a specific pattern in which logic values 1 and 0 are repeated, heat of a considerably high temperature is generated in the switches of the data drive ICs, thereby burning the switches.

For example, when the number of discharge cells disposed on the address electrode Xa is 200 and the data voltage Vd is supplied to every other discharge cell of 200 discharge cells, heat corresponding to a maximum power of 12,000 W [(60/30)×60×100] is generated in the top switch Qt1 during an address period of a subfield.

SUMMARY OF THE INVENTION

Accordingly, an object of the present invention is to solve at least the problems and disadvantages of the background art.

An embodiment of the present invention provides a plasma display apparatus with an improved operation stability by preventing thermal and electrical damages of a data drive integrated circuit, and a driving method of the same.

According to an aspect, there is provided a plasma display apparatus comprising a plasma display panel comprising an address electrode, and a driver for supplying the first data pulse to the address electrode when a temperature of the plasma display panel or an ambient temperature of the plasma display panel is less than a first temperature, wherein the driver supplies the second data pulse different from the first data pulse to the address electrode when the temperature of the plasma display panel or the ambient temperature of the plasma display panel is equal to or more than the first temperature.

The operation stability of the plasma display apparatus according to the embodiment of the present invention is improved by adding an energy recovery circuit to a data driver for supplying a data pulse.

BRIEF DESCRIPTION OF THE DRAWINGS

The accompany drawings, which are included to provide a further understanding of the invention and are incorporated in and constitute a part of this specification, illustrate embodiments of the invention and together with the description serve to explain the principles of the invention. In the drawings.

DETAILED DESCRIPTION OF PREFERRED EMBODIMENTS

Reference will now be made in detail to embodiments of the present invention, examples of which are illustrated in the accompanying drawings.

A plasma display apparatus according to an aspect of the present invention comprises a plasma display panel comprising an address electrode, and a driver for supplying a first data pulse to the address electrode when a temperature of the plasma display panel or an ambient temperature of the plasma display panel is less than a first temperature. The driver supplies the second data pulse different from the first data pulse to the address electrode when the temperature of the plasma display panel or the ambient temperature of the plasma display panel is equal to or more than the first temperature.

The first data pulse and the second data pulse are applied in the same subfield.

Voltage rising period and/or voltage falling period of the second data pulse is longer than voltage rising period and/or voltage falling period of the first data pulse.

The voltage rising period ranges from 10% of a maximum value of the first data pulse or the second data pulse to 90% of the maximum value, and the voltage falling period ranges from 90% of the maximum value to 10% of the maximum value.

The voltage rising period and/or the voltage falling period of the first data pulse or the second data pulse ranges from 500 ns to 1,000 ns.

A plasma display apparatus according to another aspect of the present invention comprises a plasma display panel comprising an address electrode, a data driver for supplying a data pulse to the address electrode, and an energy recovery circuit for supplying a data pulse different from the data pulse supplied from the data driver to the address electrode depending on a temperature of the plasma display panel or an ambient temperature of the plasma display panel.

A method of driving a plasma display apparatus according to still another aspect of the present invention comprises supplying a first data pulse to an address electrode when a temperature of a plasma display panel or an ambient temperature of the plasma display panel is less than a first temperature, and supplying a second data pulse different from the first data pulse to the address electrode when the temperature of the plasma display panel or the ambient temperature of the plasma display panel is equal to or more than the first temperature.

Hereinafter, exemplary embodiments of the present invention will be described in detail with reference to the attached drawings.

Figure 3:
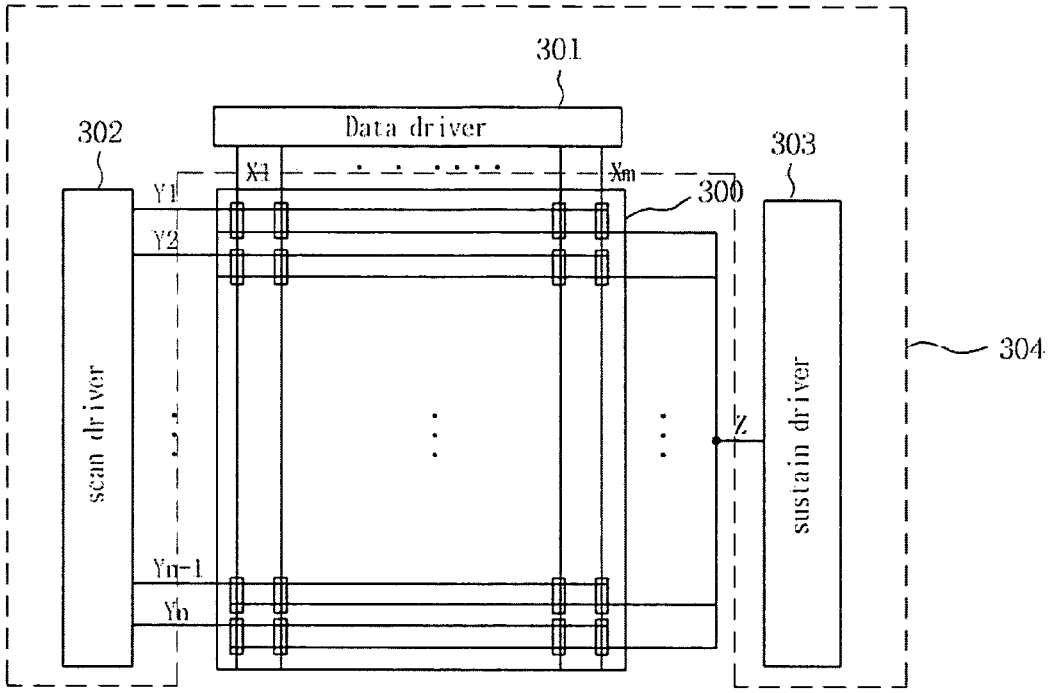
FIG. 3 shows a structure of a plasma display apparatus according to an embodiment of the present invention.

FIG. 3 shows a structure of a plasma display apparatus according to an embodiment of the present invention.

As shown in FIG. 3, the plasma display apparatus according to the embodiment of the present invention comprises a plasma display panel 300 and a driver 304.

The plasma display panel 300 comprises a front panel (not shown) and a rear panel (not shown) which are coalesced with each other at a given distance therebetween. A plurality of electrodes, for example, a plurality of address electrodes X are formed on the plasma display panel 300. A structure of the plasma display panel 300 will be described in detail with reference to FIG. 4.

Figure 4:
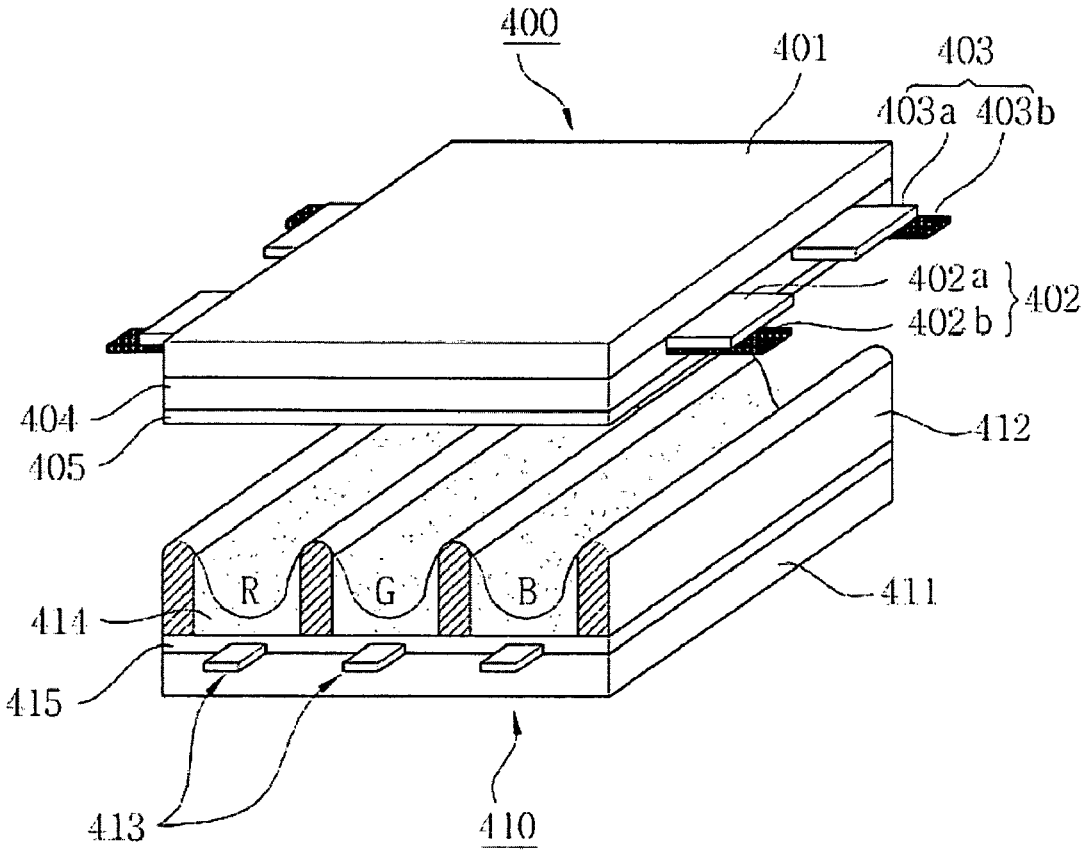
FIG. 4 shows a structure of a plasma display panel of the plasma display apparatus according to the embodiment of the present invention.

FIG. 4 shows a structure of a plasma display panel of the plasma display apparatus according to the embodiment of the present invention.

As shown in FIG. 4, the plasma display panel comprises a front panel 400 and a rear panel 410 which are coupled in parallel at a given distance therebetween. A plurality of maintenance electrodes comprising a plurality of scan electrodes 402 and Y and a plurality of sustain electrodes 403 and Z are formed on a front substrate 401 of the front panel 400, which is a display surface for displaying an image. A plurality of address electrodes 413 and X are formed on a rear substrate 411 of the rear panel 410 to intersect the plurality of maintenance electrodes.

The maintenance electrode maintains light-emissions of cells by a mutual discharge between the scan electrodes 402 and Y and the sustain electrodes 403 and Z in one discharge space, that is, one discharge cell. The scan electrode 402 and Y and the sustain electrode 403 and Z each comprise transparent electrodes 402*a* and 403*a* made of a transparent material, for example, indium-tin-oxide (ITO) and bus electrodes 402*b* and 403*b* made of a metal material.

One or more upper dielectric layers 404 are covered on an upper part of the maintenance electrode to limit a discharge current and to provide insulation between the maintenance electrodes. A protective layer 105 depositing with MgO is formed on an upper surface of the upper dielectric layer 404 to facilitate discharge conditions.

A plurality of stripe-type (or well-type) barrier ribs 412 are formed in parallel on the rear panel 410 to form a plurality of discharge spaces, that is, a plurality of discharge cells. The plurality of address electrodes 413 and X are formed in parallel with the barrier ribs 412 to perform an address discharge and generate vacuum ultraviolet rays.

Red (R), green (G) and blue (B) phosphors 414 are coated on an upper surface of the rear panel 410 to emit visible light for an image display during the address discharge. A lower dielectric layer 415 is formed between the address electrodes 413 and X and the phosphors 414 to protect the address electrodes 413 and X.

An example of the plasma display panel capable of being used in the present invention is shown and described with reference to FIG. 4. However, the present invention is not limited thereto.

For example, the scan electrodes 402 and Y, the sustain electrodes 403 and Z and the address electrodes 413 and X are formed on the plasma display panel 300 in FIG. 4. However, the scan electrodes 402 and Y or the sustain electrodes 403 and Z may be omitted in the plasma display panel 300 used in the plasma display apparatus according to the embodiment of the present invention.

In other words, the maintenance electrode comprises both the scan electrodes 402 and Y and the sustain electrodes 403 and Z in FIG. 4. However, the maintenance electrode may comprise the scan electrodes 402 and Y or the sustain electrodes 403 and Z.

The scan electrodes 402 and Y and the sustain electrodes 403 and Z each comprise the transparent electrodes 402*a* and 403*a* and the bus electrodes 402*b* and 403*b* in FIG. 4. However, at least one of the scan electrodes 402 and Y and the sustain electrodes 403 and Z may comprise only the bus electrodes 402*b* and 403*b*.

The scan electrodes 402 and Y and the sustain electrodes 403 and Z are formed on the front panel 400 and the address electrodes 413 and X are formed on the rear panel 410 in FIG. 4. However, the scan electrodes 402 and Y, the sustain electrodes 403 and Z and the address electrodes 413 and X may be formed on the front panel 400. Further, at least one of the scan electrodes 402 and Y, the sustain electrodes 403 and Z or the address electrodes 413 and X may be formed on the barrier rib 412.

In short, the plasma display panel capable of being used in the embodiment of the present invention comprises the plurality of address electrodes and the maintenance electrodes, and the remaining conditions do not matter.

The description of FIG. 4 is finished and the description of FIG. 3 is again continued.

The driver 304 supplies a predetermined driving voltage to the plurality of electrodes formed on the plasma display panel 300 in several subfields of one frame.

Here, a structure of a frame for driving the plurality of electrodes of the plasma display panel 300 will be described in detail with reference to FIG. 5.

Figure 5:
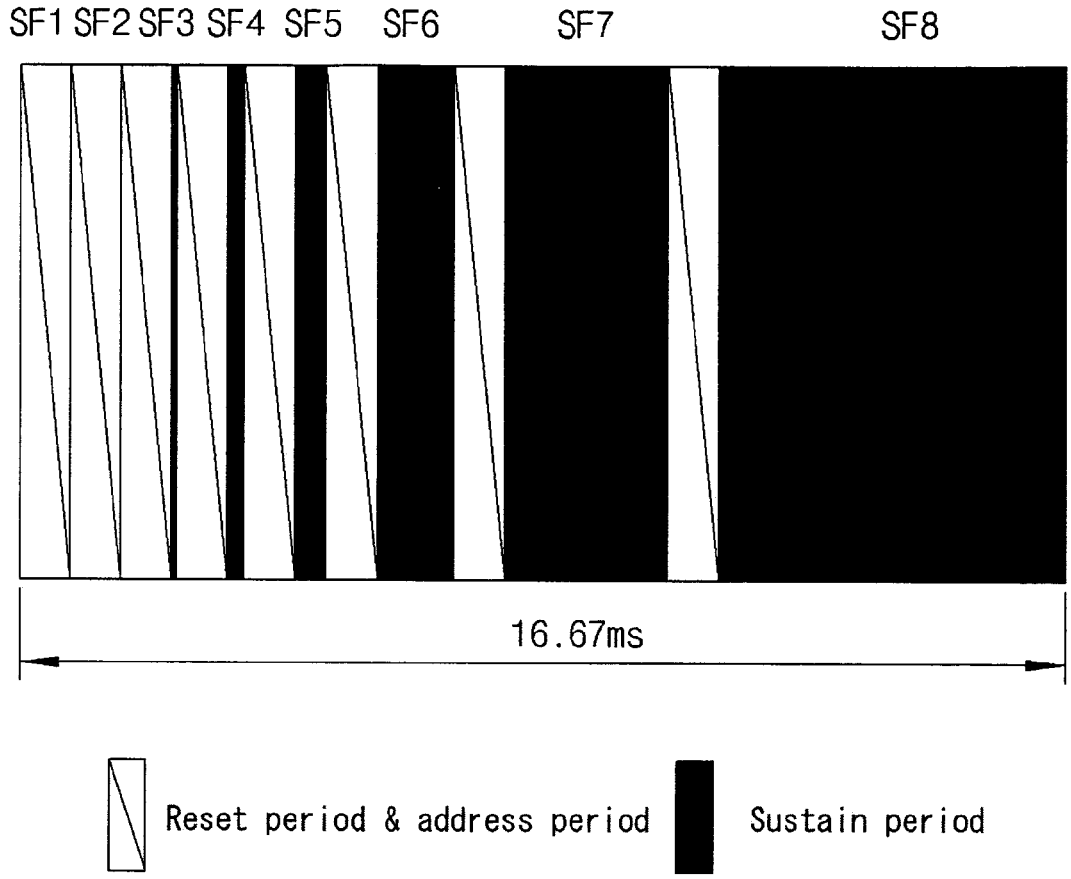
FIG. 5 illustrates a method for representing gray scale of an image in the plasma display apparatus according to the embodiment of the present invention.

FIG. 5 illustrates a method for representing gray scale of an image in the plasma display apparatus according to the embodiment of the present invention.

As shown in FIG. 5, one frame in the plasma display apparatus is divided into several subfields whose number of light-emissions are different from one another. Although it is not shown, each of the subfields comprises a reset period for initializing all of the discharge cells, an address period for selecting cells to be discharged and a sustain period for representing gray scale in accordance with number of discharges.

For example, in a case of representing gray scale of 256 images, a frame period (16.67 ms) corresponding to 1/60 second is divided into eight subfields SF1 to SF8. The eight subfields SF1 to SF8 each comprise a reset period, an address period and a sustain period.

The duration of the reset period in a subfield is equal to the duration of the reset periods in the remaining subfields. Likewise the reset period, the duration of the address period in a subfield is equal to the duration of the address periods in the remaining subfields.

The voltage difference between the address electrode X and the scan electrode Y generates the address discharge for selecting the cells to be discharged.

The sustain period determines gray level weight of each of the subfields. For example, gray level weight of a first subfield is set as 20 and gray level weight of a second subfield is set as 21. In other words, gray level weight of each of the subfields can be determined to increase a gray level weight of each of the subfields at a ratio of $2^n$ (n=0, 1, 2, 3, 4, 5, 6, 7). Grey level of various images is represented by controlling the number of sustain pulses supplied during the sustain period of each of the subfields depending on gray level weight of each of the subfields during the sustain period.

The plasma display apparatus according to the embodiment of the present invention uses the plurality of frames for displaying an image during 1 second. For example, 60 frames are used for displaying the image during 1 second.

One frame comprises eight subfields in FIG. 5. However, the number of subfields included in one frame can be variously changed. For example, one frame may comprise twelve subfields or ten subfields.

Image quality of the plasma display apparatus representing gray scale of an image using a frame is determined depending on the number of subfields included in a frame. For example, when the number of subfields is 12, gray scale of 212 images is represented. When the number of subfields is 8, gray scale of 28 images is represented.

Further, the plurality of subfields are arranged in the order, in which gray level weight increases, in FIG. 5. However, the plurality of subfields may be arranged in the order, in which gray level weight decreases. Further, the plurality of subfields may be arranged irrespective of gray level weight.

The description of FIG. 5 is finished and the description of FIG. 3 is again continued.

The structure of the driver 304 for driving the plurality of electrodes of the plasma display panel 300 in several subfields of one frame can be variably changed depending on the plurality of electrodes formed on the plasma display panel 300.

When the scan electrode Y and the sustain electrode Z are formed in parallel on the plasma display panel 300 and the address electrode X is formed to interest the scan electrode Y and the sustain electrode Z, it is preferable that the driver 304 comprises a data driver 301, a scan driver 302 and a sustain driver 304.

As described above, an operation of the driver 304 comprising the data driver 301, the scan driver 302 and the sustain driver 304 will be described with reference to FIG. 6.

Figure 6:
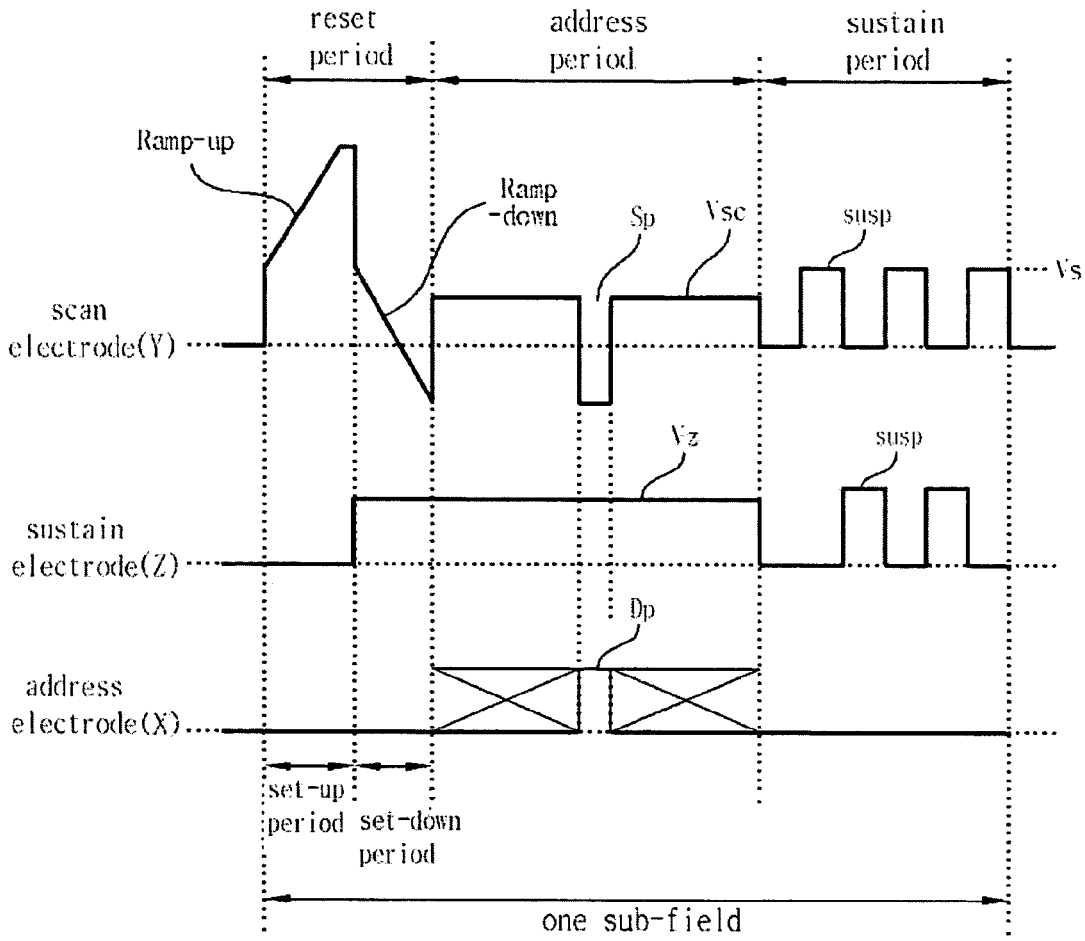
FIG. 6 illustrates an operation of a driver comprising a data driver, a scan driver and a sustain driver in the plasma display apparatus according to the embodiment of the present invention.

FIG. 6 illustrates an operation of a driver comprising a data driver, a scan driver and a sustain driver.

As shown in FIG. 6, the driver 304 supplies a driving pulse to the address electrode X, the scan electrode Y and the sustain electrode Z during a reset period, an address period and a sustain period.

As shown in FIG. 6, the driver 304 supplies a rising waveform Ramp-up to the scan electrode Y during a setup period of the reset period. Preferably, the scan driver 302 of the driver 304 supplies the rising waveform Ramp-up to the scan electrode Y.

A weak dark discharge is generated within the discharge cells of the entire screen by the rising waveform Ramp-up. By performing the weak dark discharge, positive wall charges are accumulated on the address electrodes X and the sustain electrodes Z and negative wall charges are accumulated on the scan electrodes Y.

In a set-down period, the driver 304, preferably, the scan driver 302 of the driver 304 supplies a falling waveform Ramp-down, which falls from a positive voltage lower than a peak voltage of the rising waveform Ramp-up to a specific voltage of a ground level voltage or less, to the scan electrodes Y.

The falling waveform Ramp-down generates a weak erasure discharge within the discharge cells. The weak erasure discharge sufficiently erases the wall charges excessively formed within the discharge cells. By performing the weak erase discharge, the wall charges uniformly remain within the discharge cells to the degree that there is the generation of a stable address discharge.

In the address period, the driver 304, preferably, the scan driver 302 of the driver 304 supplies a negative scan pulse Sp falling from a scan reference voltage Vsc to the scan electrode Y. Moreover, the driver 304, preferably, the data driver 301 of the driver 304 supplies a positive data pulse Dp synchronized with the scan pulse Sp to the address electrode X.

While the voltage difference between the negative scan pulse Sp and the positive data pulse Dp is added to the wall charges produced during the reset period, the address discharge is generated within the discharge cells to which the data pulse Dp is applied. The wall charges necessary for a sustain discharge when applying a sustain voltage Vs are formed within the discharge cells selected by performing the address discharge. Accordingly, the scanning of the scan electrode Y is performed.

In the sustain period, the driver 304 alternately supplies a sustain pulse SUSp to at least one of the scan electrode Y and the sustain electrode Z. Preferably, each of the scan driver 302 and the sustain driver 304 of the driver 304 alternately supplies the sustain pulse SUSp to each of the scan electrode Y and the sustain electrode Z.

While the wall voltage within the cells selected by performing the address discharge is added to the sustain pulse SUSp, a sustain discharge, that is, a display discharge, is generated between the scan electrode Y and the sustain electrode Z whenever the sustain pulse SUSp is applied.

An operation of the driver 304, preferably, the data driver 301 for supplying the data pulse Dp synchronized with the scan pulse Sp to the address electrode X during the address period will be described in detail with reference to FIG. 7.

Figure 7:
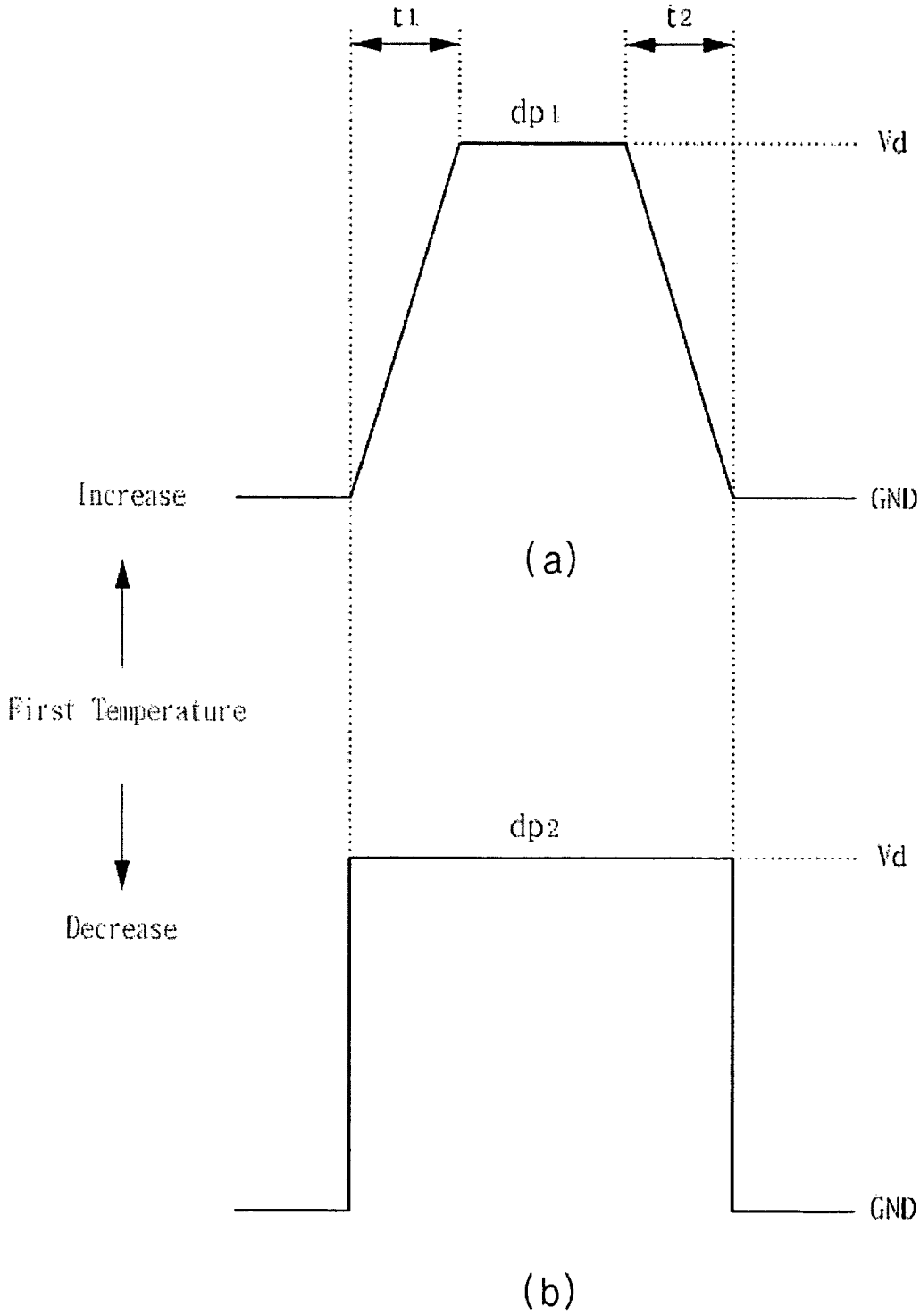
FIG. 7 illustrates an operation of the driver of the plasma display apparatus according to the embodiment of the present invention.

FIG. 7 illustrates an operation of the driver of the plasma display apparatus according to the embodiment of the present invention.

As shown in FIG. 7, a plurality of data pulses are supplied to the address electrode X during the address period. When a temperature of the data driver 301 is equal to or more than a first temperature, a first data pulse dp1 is supplied. Further, when the temperature of the data driver 301 is less than the first temperature, one or more second data pulses dp2 different from the first data pulse dp1 are supplied.

The first temperature means a temperature scope having a variable section at user's request. In other words, the first temperature can be determined at user's need, and thus the first temperature according to the embodiment of the present invention may be a variable temperature section having a given temperature scope.

It is preferable that voltage rising period and/or voltage falling period of the first data pulse dp1 is longer than voltage rising period and/or voltage falling period of the second data pulse dp2.

When a temperature of the data driver 301 is equal to or more than the first temperature, one or more first data pulses dp1, whose the voltage rising period and/or the voltage falling period is longer than the voltage rising period and/or the voltage falling period of the second data pulse dp2, are supplied.

More specifically, the driver 304, preferably, the data driver 301 of FIG. 3 supplies the plurality of data pulses to the address electrode X during the address period. At this time, when the temperature of the data driver 301 is equal to or more than the first temperature, one or more first data pulses dp1, whose the voltage rising period and/or the voltage falling period is longer than the voltage rising period and/or the voltage falling period of the second data pulse dp2, are supplied to the address electrode X, as shown in (a) and (b) of FIG. 7.

The voltage rising period and/or the voltage falling period of the data pulse supplied to the address electrode X can be variably changed depending on the temperature of the driver, preferably, the data driver for supplying the data pulse.

A method of supplying the first data pulse dp1 of the relatively long voltage rising period and/or the relatively long voltage falling period will be described with reference to FIG. 8.

Figure 8A:
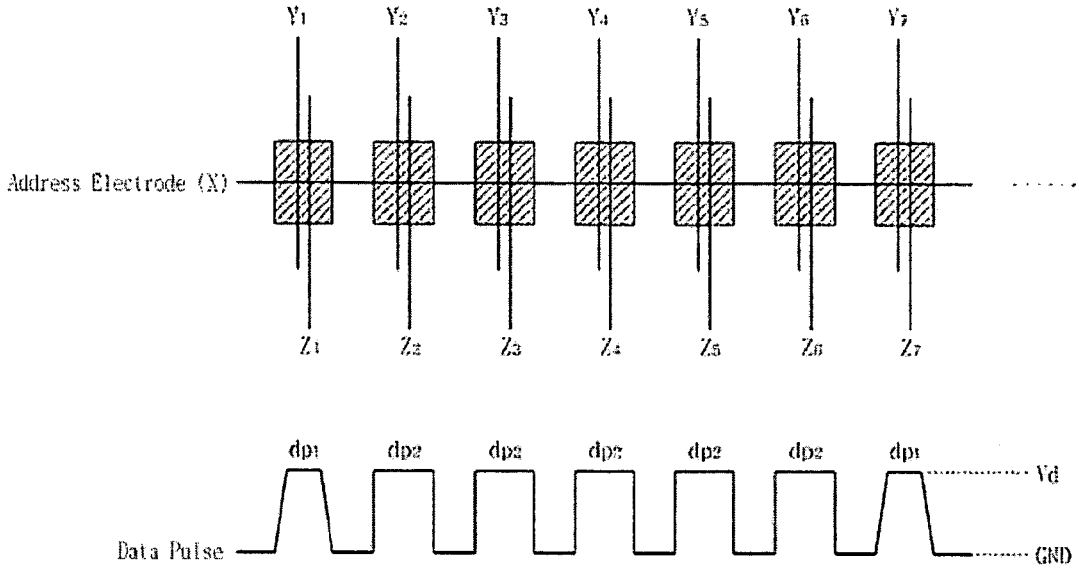
FIGS. 8*a* and 8*b* illustrate a method of supplying a first data pulse of FIG. 7.
Figure 8B:
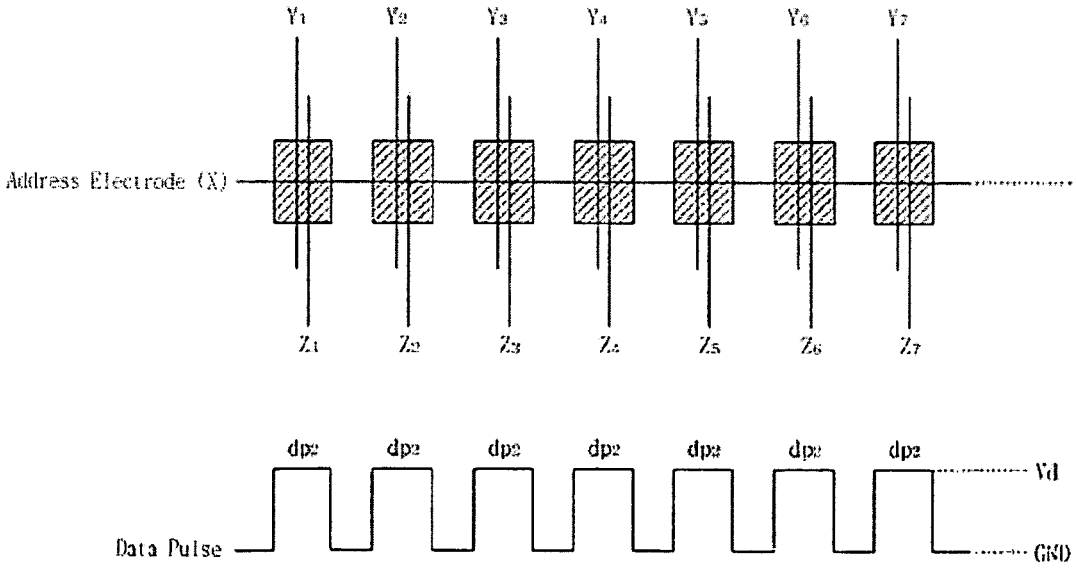

FIGS. 8*a* and 8*b* illustrate a method of supplying a first data pulse of FIG. 7.

When the temperature of the driver, preferably, the data driver for supplying the data pulse is relatively high and equal to or more than the first temperature, a pattern of a data pulse shown in FIG. 8*a* is supplied to the address electrode X. When the temperature of the driver, preferably, the data driver for supplying the data pulse is relatively low and less than the first temperature, a pattern of a data pulse shown in FIG. 8*b* is supplied to the address electrode X.

As shown in FIG. 8*b*, all of the data pulses supplied to the address electrode X have relatively short voltage rising period and/or relatively short voltage falling period, like the second data pulse dp2 of FIG. 7.

On the other hand, as shown in FIG. 8*a*, a first data pulse supplied to a discharge cell located on a scan electrode Y1 and a sustain electrode Z1 and a last data pulse supplied to a discharge cell located on a scan electrode Y7 and a sustain electrode Z7 among the plurality of data pulses supplied to the address electrode X each have relatively long voltage rising period and/or relatively long voltage falling period, like the first data pulse dp1 of FIG. 7.

In short, as shown in FIG. 8(*a*), when the temperature of the driver, preferably, the data driver is relatively high and equal to or more than the first temperature, one or more first data pulses dp1 of the relatively long voltage rising period and/or the relatively long voltage falling period are supplied. As shown in FIG. 8(*b*), when the temperature of the driver, preferably, the data driver is relatively low and less than the first temperature, the first data pulse dp1 is not supplied.

However, one or more first data pulses may be supplied at the first temperature or more and below the first temperature.

When one or more first data pulses of the relatively long voltage rising period and/or the relatively long voltage falling period are supplied at the first temperature or more and below the first temperature as described above, it is preferable that the number of first data pulses at the first temperature or more is more than the number of first data pulses below the first temperature.

As described above, a condition for supplying the data pulse of the relatively long voltage rising period and/or the relatively long voltage falling period, that is, a temperature of the driver, preferably, the data driver will be described with reference to FIGS. 9*a* and 9*b*.

Figure 9A:
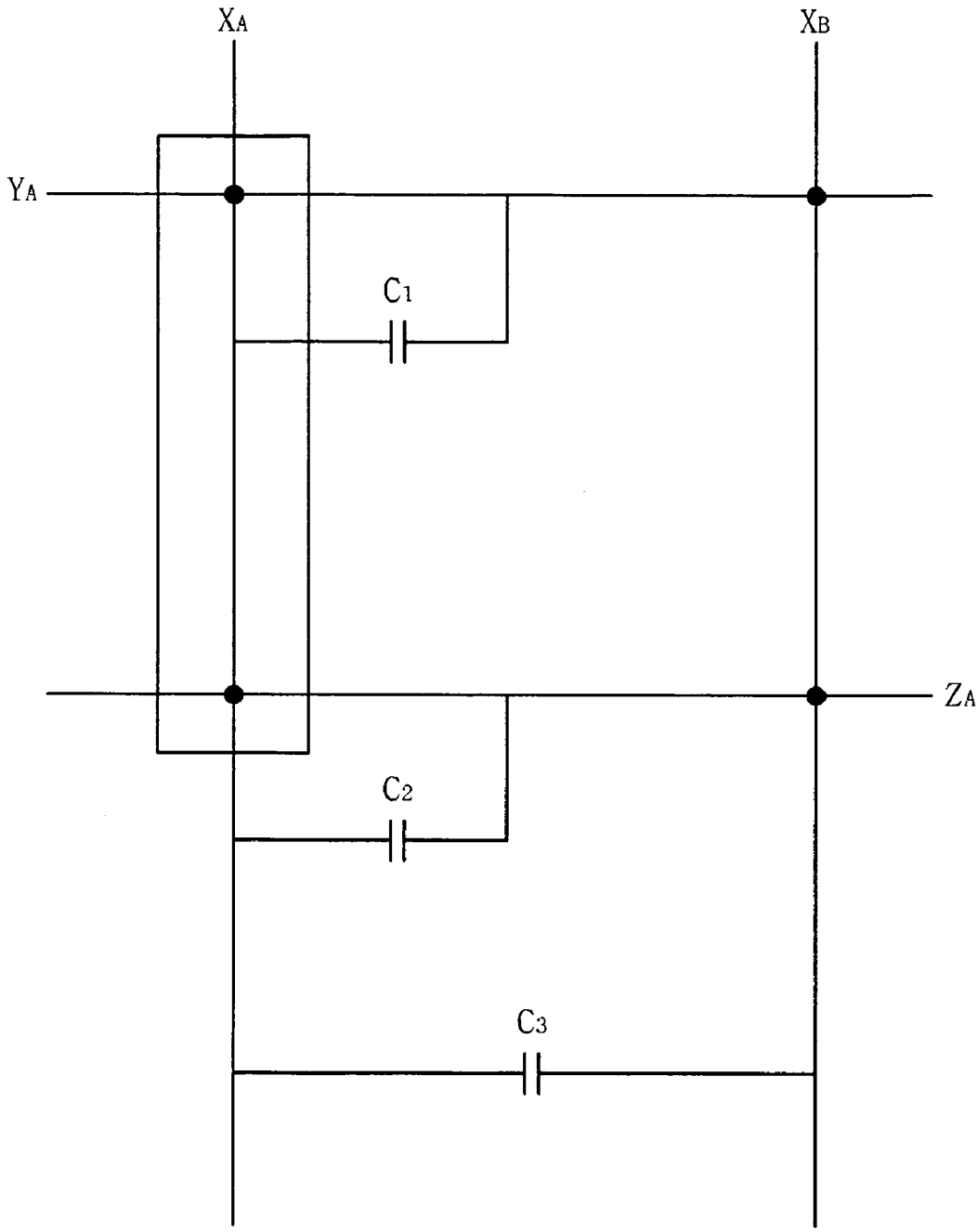
FIGS. 9*a* and 9*b* respectively illustrate equivalent capacitances of each discharge cell and patterns of data pulses applied to the discharge cell.
Figure 9B:
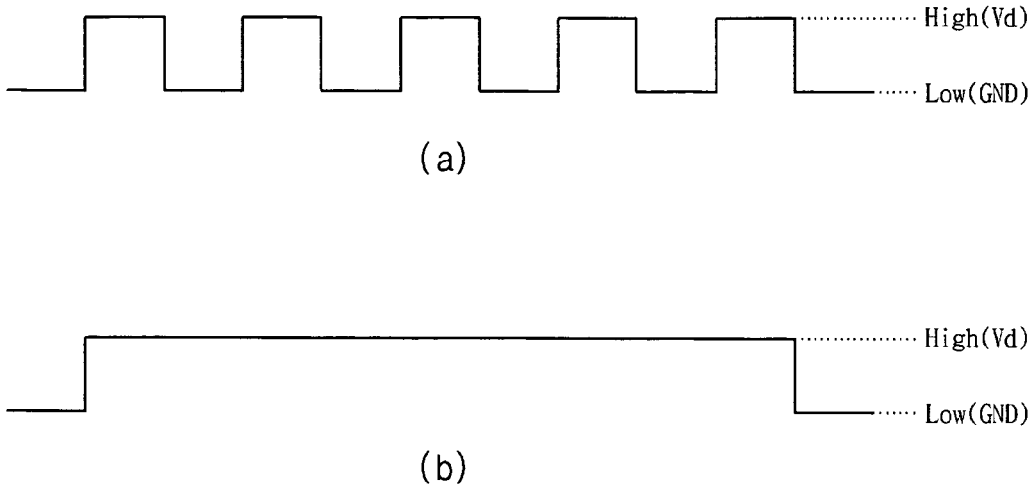

FIGS. 9*a* and 9*b* respectively illustrate equivalent capacitances of each discharge cell and patterns of data pulses applied to the discharge cell.

As shown in FIG. 9*a*, equivalent capacitance is formed between the address electrodes X of the plasma display panel. Further, equivalent capacitance is formed between the address electrode X and the scan electrode Y and between the address electrode X and the sustain electrode Z.

For example, as shown in FIG. 9*a*, a discharge cell is formed at each of points where a maintenance electrode, that is, a scan electrode $Y_A$ and a sustain electrode $Z_A$, which are formed in parallel, intersect address electrodes $X_A$ and $X_B$. Here, a capacitor C1 having capacitance of a predetermined magnitude is equivalently formed between the address electrode $X_A$ and the scan electrode $Y_A$. A capacitor C2 having capacitance of a predetermined magnitude is equivalently formed between the address electrode $X_A$ and the sustain electrode $Z_A$. A capacitor C3 having capacitance of a predetermined magnitude is equivalently formed between the address electrode $X_A$ and the address electrode $X_B$.

As described above, one discharge cell of the plasma display panel is understood as the capacitor having equivalence capacitance of the predetermined magnitude.

When driving the plasma display panel, a displacement current id flowing in one address electrode X is determined depending on the equivalence capacitance of the discharge cell and a change rate of a voltage per unit time.

The displacement current id is represented by the following Equation 2.

$$\text{Displacement Current } (id) = C(\text{capacitance}) \times dV/dt \qquad \text{[Equation 2]}$$

As shown in the above Equation 2, supposing that a change rate of a voltage V per time t is fixed, the displacement current id is determined by the equivalence capacitance C. That is, when the equivalence capacitance C increases, the displacement current id increases. On the contrary, when the equivalence capacitance C decreases, the displacement current id decreases. Here, heat generated in the driver, preferably, the data driver is proportional to a magnitude of the displacement current id.

That is, when the magnitude of the displacement current id increases, the amount of heat generated in the data driver increases. On the contrary, when the magnitude of the displacement current id decreases, the amount of heat generated in the data driver decreases.

The above-described equivalence capacitance C is determined depending on a pattern of the data pulse supplied to the address electrode X.

As shown in FIG. 9*b*, a pattern of the data pulse, in which logical values of high and low repeat, is shown in (a) of FIG. 9*b*. In a case of (a) of FIG. 9*b*, the data pulse of the data voltage Vd is supplied to every other discharge cell of the plurality of discharge cells.

A pattern of the data pulse, in which a logical value of high is maintained, is shown in (b) of FIG. 9*b*. In a case of (b) of FIG. 9*b*, the data pulse of the data voltage Vd is supplied to all of the plurality of discharge cells.

A logical level of the data pulse is maintained at a fixed level in (b) of FIG. 9*b*, and thus dV/dt of the above Equation 2 is zero. Therefore, the displacement current id does not flow. Accordingly, an extremely small amount of heat is generated in the driver, preferably, the data driver.

On the contrary, a logical level of the data pulse constantly changes in (a) of FIG. 9*b*, and thus the displacement current id according to the above Equation 2 has the maximum value. In other words, the displacement current id is generated in proportional to the number of changes of the logical level of the data pulse in (a) of FIG. 9*b*.

A load value of an image signal is determined by the number of changes of the logical level of the data pulse in consideration of the pattern of the data pulse of FIG. 9*b*.

When the pattern of the data pulse shown in (a) of FIG. 9*b* is supplied, the displacement current of the excessively large magnitude flows in the driver, preferably, the data driver.

Accordingly, heat is generated in the data driver to the degree that there is the generation of thermal damage of the data driver.

After all, the driver, preferably, the data driver is thermally and electrically damaged.

(a) of FIG. 9*b* corresponds to a case where the temperature of the data driver is equal to or more than the first temperature. (b) of FIG. 9*b* corresponds to a case where the temperature of the data driver is less than the first temperature.

As in (a) of FIG. 9*b*, when the temperature of the data driver is relatively high, a data pulse of relatively long voltage rising period and/or relatively long voltage falling period is supplied like the first data pulse dp1 of FIG. 7. This reason is that heat generated in the data driver is prevented from being concentrated in a specific switching element, preferably, a data drive IC. Accordingly, thermal and electrical stability of the data driver is ensured.

An operation of the data driver will be later described in detail with reference to FIG. 15.

A data pulse of relatively long voltage rising period and/or relatively long voltage falling period, like the first data pulse dp1 of FIG. 7, will be described in detail with reference to FIG. 10.

Figure 10:
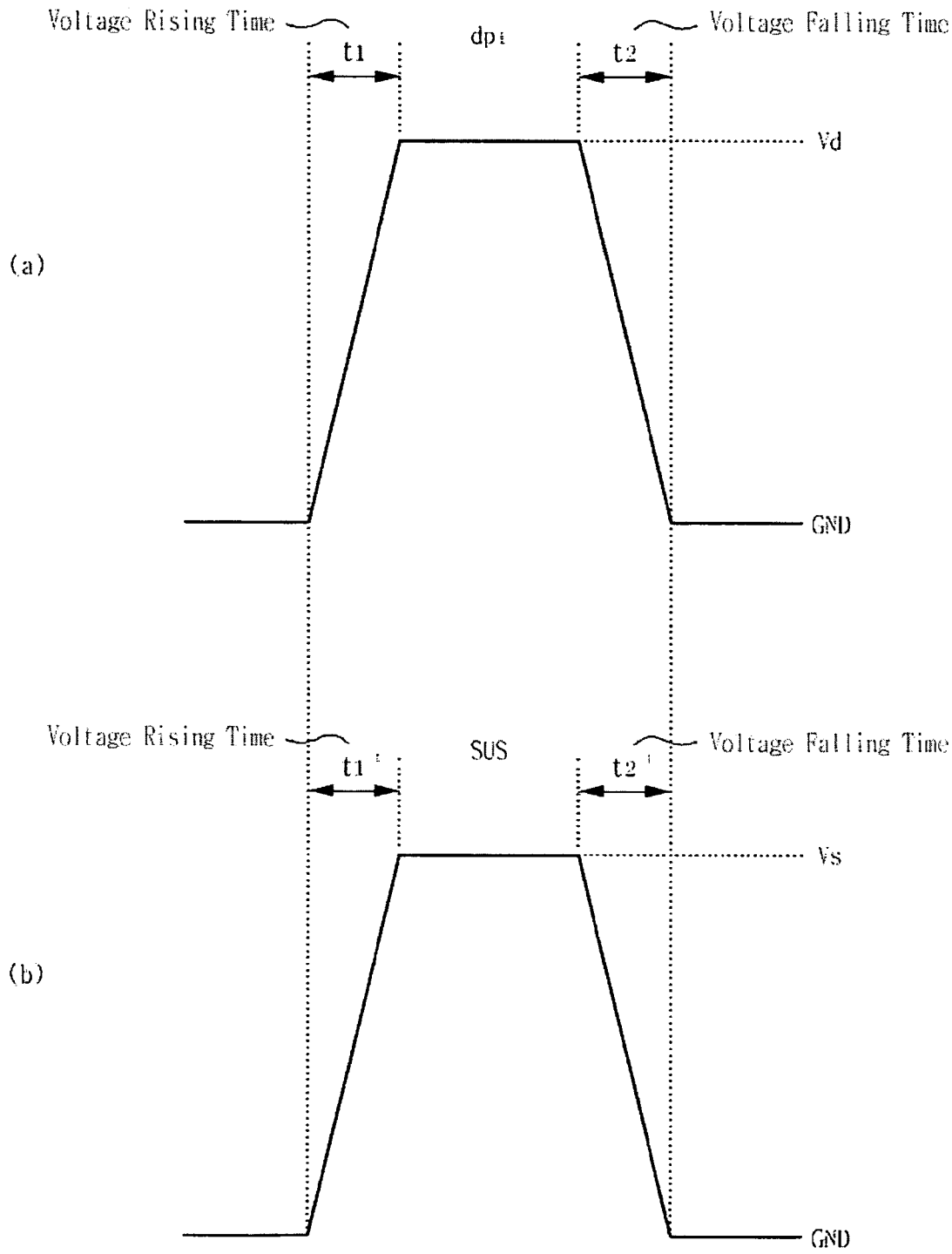
FIG. 10 illustrates a data pulse, whose voltage rising period and/or voltage falling period is relatively long.

FIG. 10 illustrates a data pulse, whose voltage rising period and/or voltage falling period is relatively long.

As shown in FIG. 10, a voltage of the first data pulse dp1 (refer to FIG. 8*a*) supplied to the discharge cell located on the scan electrode Y1 and the sustain electrode Z1 gradually rises from the ground level voltage GND to the data voltage Vd during voltage rising period t1. Then, a voltage of the first data pulse dp1 gradually falls from the data voltage Vd to the ground level voltage GND during voltage falling period t2. It is preferable that the voltage rising period t1 is approximately equal to the voltage falling period t2. Further, the voltage rising period t1 may be different from the voltage falling period t2.

On the contrary, the second data pulse dp2 (refer to FIG. 8*a*) supplied to a discharge cell located on a scan electrode Y2 and a sustain electrode Z2 is not shown in FIG. 10. However, a voltage of the second data pulse dp2 sharply rises from the ground level voltage GND to the data voltage Vd, and sharply falls from the data voltage Vd to the ground level voltage GND.

Voltage rising period and/or voltage falling period of the first data pulse dp1 is longer than voltage rising period and/or voltage falling period of the second data pulse dp2.

It is preferable that as shown in (a) of FIG. 10, the voltage rising period and/or the voltage falling period of the first data pulse dp1 relatively longer than those of the second data pulse dp2 is approximately equal to voltage rising period and/or voltage falling period of a sustain pulse SUS supplied during the sustain period, as shown in (b) of FIG. 10.

That is, the voltage rising period t1 and the voltage falling period t2 of the first data pulse dp1 in (a) of FIG. 10 is approximately equal to voltage rising period t1' and voltage falling period t2' of the sustain pulse SUS in (b) of FIG. 10, respectively.

This reason is that a driving circuit for supplying the first data pulse dp1 and a driving circuit for supplying the sustain pulse SUS use the same energy recovery circuit.

More preferably, the voltage rising period t1 and/or the voltage falling period t2 of the first data pulse dp1 ranges from 500 ns to 1,000 ns.

This reason is that considering that the energy recovery circuit is used in the driving circuit for supplying the first data pulse dp1, switching time of the energy recovery circuit must range from 500 ns to 1,000 ns so that a driving efficiency of the energy recovery circuit is ensured. This will be described later with reference to FIG. 15.

The voltage rising period and the voltage falling period of the data pulse is determined depending on a magnitude of a maximum voltage of the data pulse. This will be described in detail with reference to FIG. 11.

Figure 11:
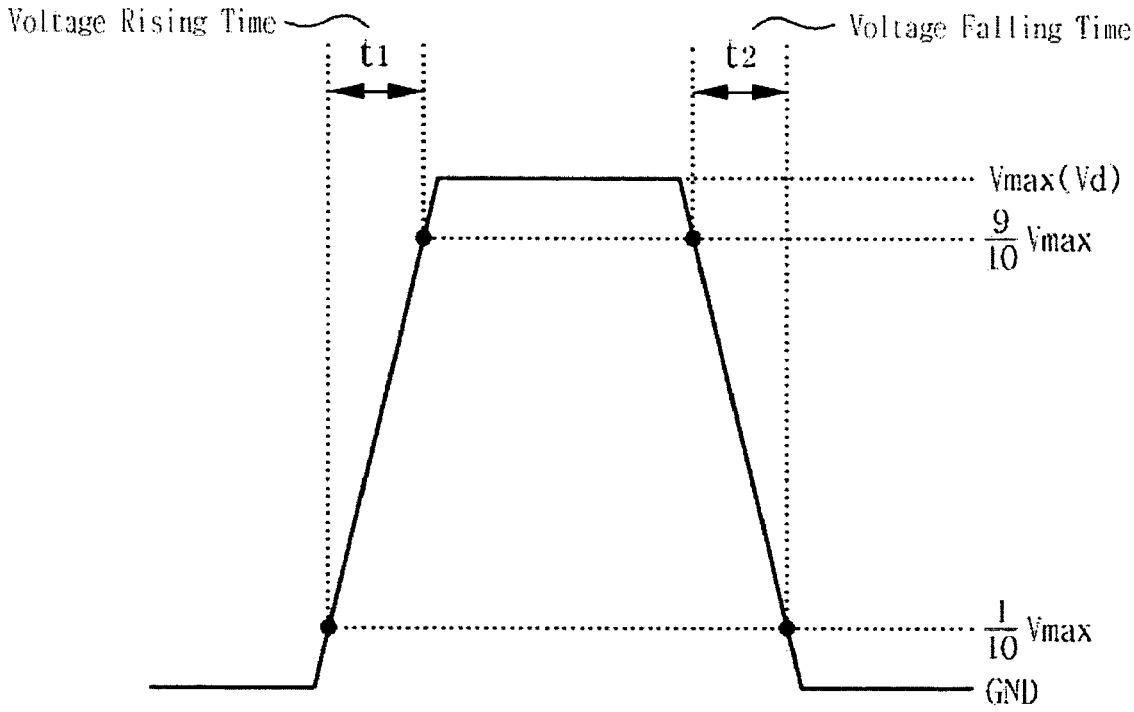
FIG. 11 illustrates a method of determining voltage rising period and voltage falling period of a data pulse.

FIG. 11 illustrates a method of determining voltage rising period and voltage falling period of a data pulse.

As shown in FIG. 11, it is preferable that the voltage rising period t1 of the data pulse ranges from an application time point of 1/10 Vmax of a maximum voltage Vmax to an application time point of 9/10 Vmax of the maximum voltage Vmax.

For example, when the maximum voltage, that is, the data voltage Vd of the data pulse is 100 V, the voltage rising period t1 of the data pulse ranges from an application time point of 10 V to an application time point of 90 V.

Further, it is preferable that the voltage falling period t2 of the data pulse ranges from an application time point of 9/10 Vmax of the maximum voltage Vmax to an application time point of 1/10 Vmax of the maximum voltage Vmax.

For example, when the maximum voltage, that is, the data voltage Vd of the data pulse is 100 V, the voltage falling period t2 of the data pulse ranges from an application time point of 90V to an application time point of 10 V.

At least one of the plurality of data pulses, for example, the voltage rising period and the voltage falling period of the first data pulse shown in FIG. 8*a* are approximately equal to each other.

However, the voltage rising period and the voltage falling period of the first data pulse may be different from each other. A method of differing the voltage rising period and the voltage falling period of the data pulse from each other will be described with reference to FIGS. 12*a* and 12*b*.

Figure 12A:
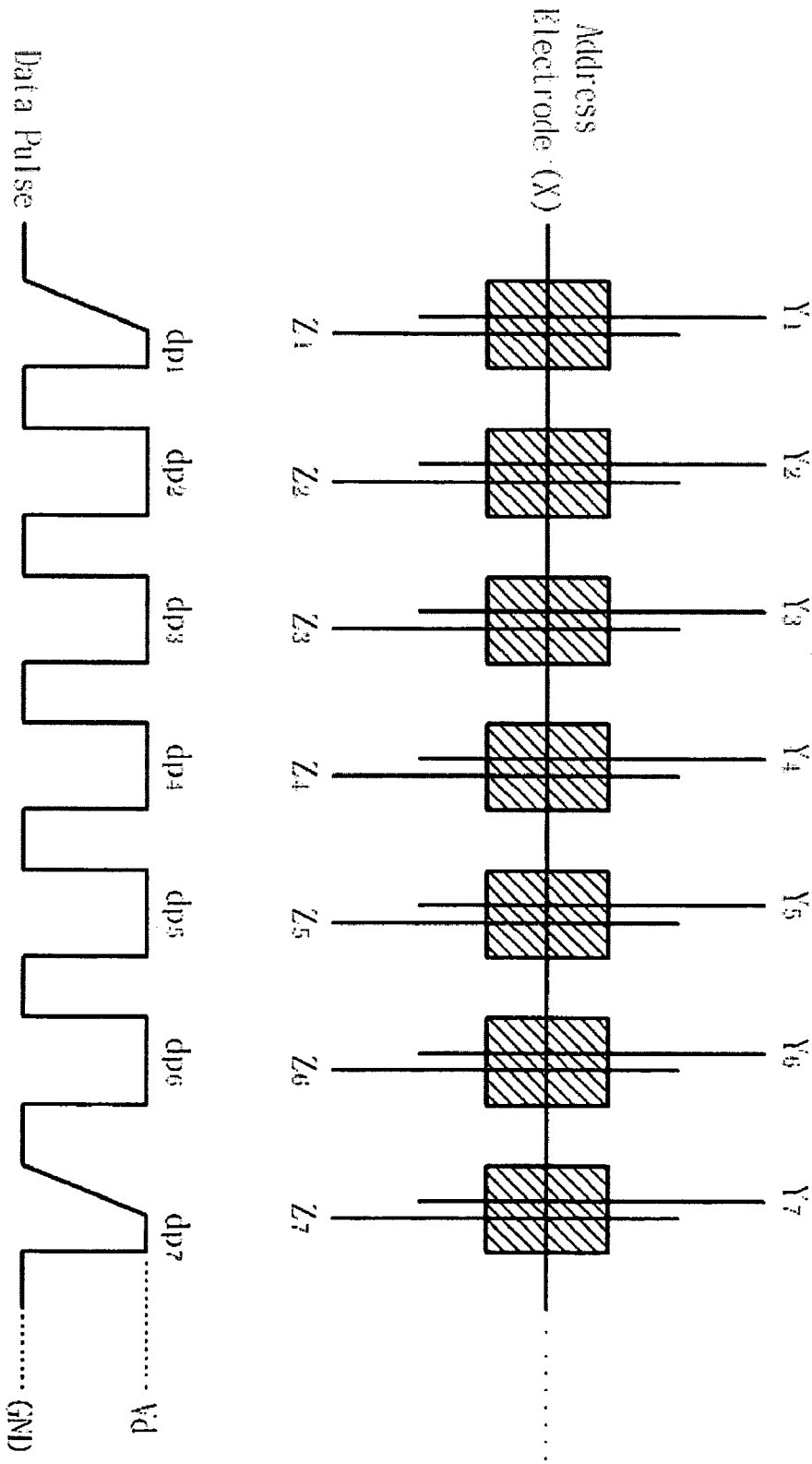
FIGS. 12*a* and 12*b* illustrate a method of differing voltage rising period and voltage falling period of a data pulse from each other.
Figure 12B:
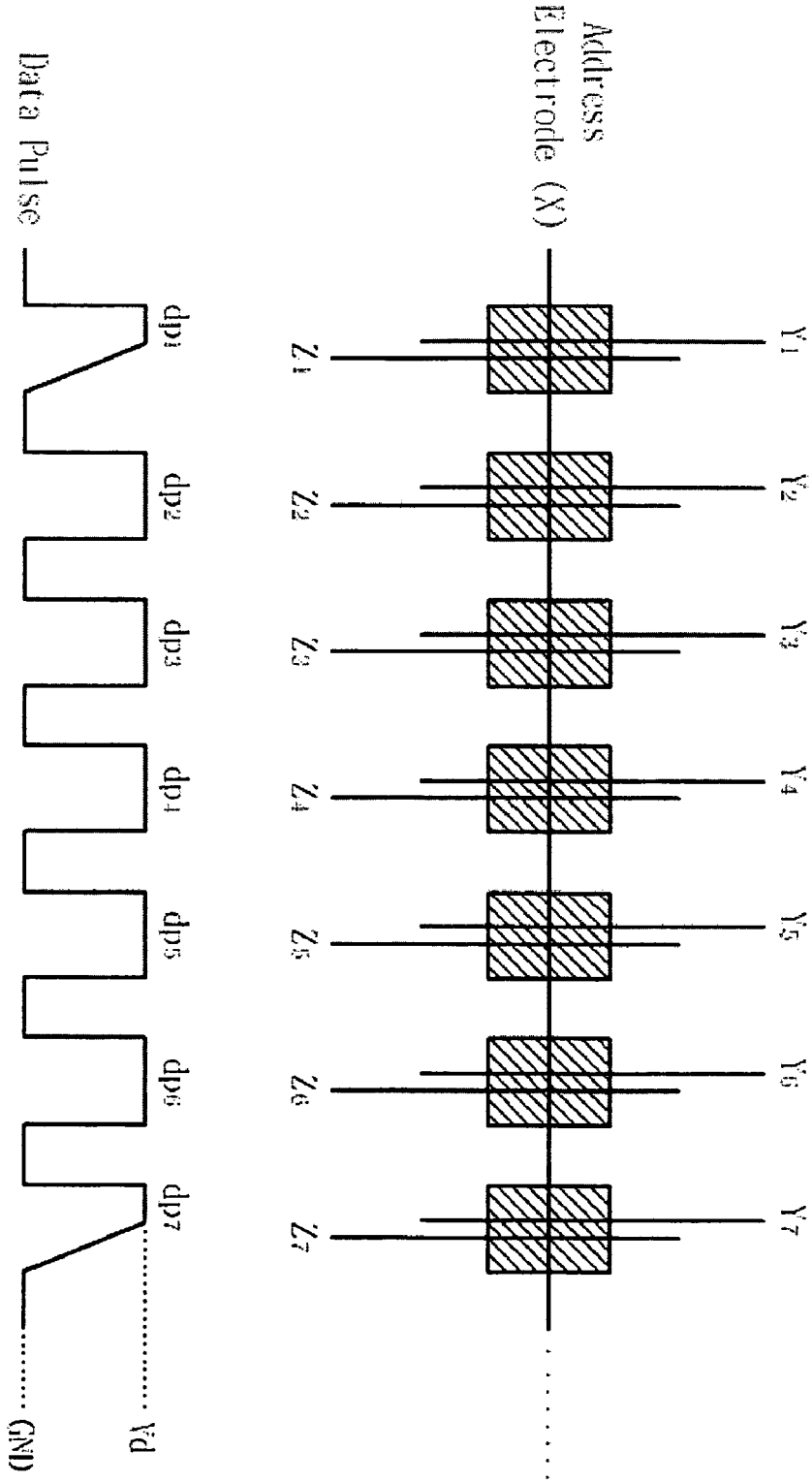

FIGS. 12*a* and 12*b* illustrate a method of differing voltage rising period and voltage falling period of a data pulse from each other.

When compared FIG. 12*a* with FIG. 8*a*, voltage rising period of the first data pulse dp1 and a seventh data pulse dp7 is longer than voltage rising period of the remaining data pulses. Further, voltage falling period of the first data pulse dp1 and the seventh data pulse dp7 is approximately equal to voltage falling period of the remaining data pulses.

When compared FIG. 12*b* with FIG. 8*a*, voltage falling period of the first data pulse dp1 and the seventh data pulse dp7 may be longer than voltage falling period of the remaining data pulses. Further, voltage rising period of the first data pulse dp1 and the seventh data pulse dp7 may be approximately equal to voltage rising period of the remaining data pulses.

The method of differing the voltage rising period and the voltage falling period of the data pulse from each other is as follows. The data voltage Vd is supplied through resonance of an inductor due to the operation of the energy recovery circuit in the driving circuit for supplying the data pulse during voltage rising period or voltage falling period. Then, the data voltage Vd is directly supplied during the remaining voltage rising period or the remaining voltage falling period.

Another method of supplying a data pulse of relatively long voltage rising period and/or relatively long voltage falling period will be described with reference to FIG. 13.

Figure 13:
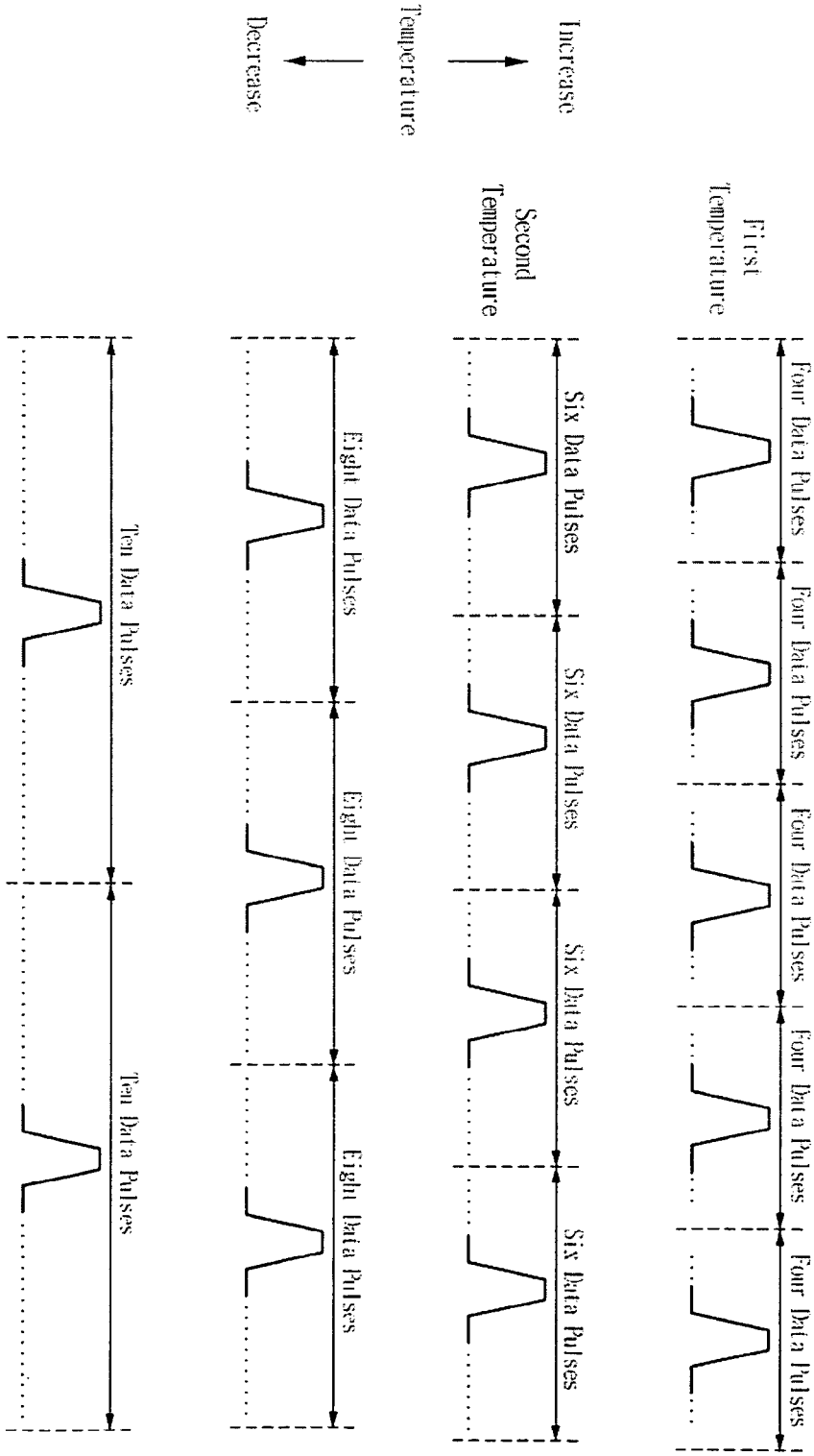
FIG. 13 illustrates another method of supplying a data pulse of relatively long voltage rising period and/or relatively long voltage falling period.

FIG. 13 illustrates another method of supplying a data pulse of relatively long voltage rising period and/or relatively long voltage falling period.

As shown in FIG. 13, as the temperature of the data driver increases, the number of data pulses of the relatively long voltage rising period and/or relatively long voltage falling period increases.

Preferably, voltage rising period and/or voltage falling period of one data pulse of predetermined-numbered data pulses among the plurality of data pulses supplied to the address electrode X is longer than voltage rising period and/or voltage falling period of the remaining data pulses.

For example, when the temperature of the data driver is relatively low and less than a second temperature, voltage rising period and/or voltage falling period of one of ten data pulses is relatively long. That is, when the data driver supplies ten data pulses, voltage rising period and/or voltage falling period of one of ten data pulses is longer than voltage rising period and/or voltage falling period of the remaining data pulses.

In other words, when the data driver supplies a total of ten data pulses, the energy recovery circuit is operated one times.

Further, when the temperature of the data driver is equal to or more than the second temperature, voltage rising period and/or voltage falling period of one of eight data pulses is relatively long. That is, when the data driver supplies eight data pulses, voltage rising period and/or voltage falling period of one of eight data pulses is longer than voltage rising period and/or voltage falling period of the remaining data pulses.

Further, when the temperature of the data driver is more than the second temperature and less than the first temperature, voltage rising period and/or voltage falling period of one of six data pulses is relatively long. When the temperature of the data driver is equal to or more than the first temperature, voltage rising period and/or voltage falling period of one of four data pulses is relatively long.

A structure and an operation of the data driver (refer to FIG. 3) for supplying one data pulse of longer voltage rising period and/or longer voltage falling period than voltage rising period and/or voltage falling period of the remaining data pulses among the plurality of data pulses will be described with reference to FIG. 14.

Figure 14:
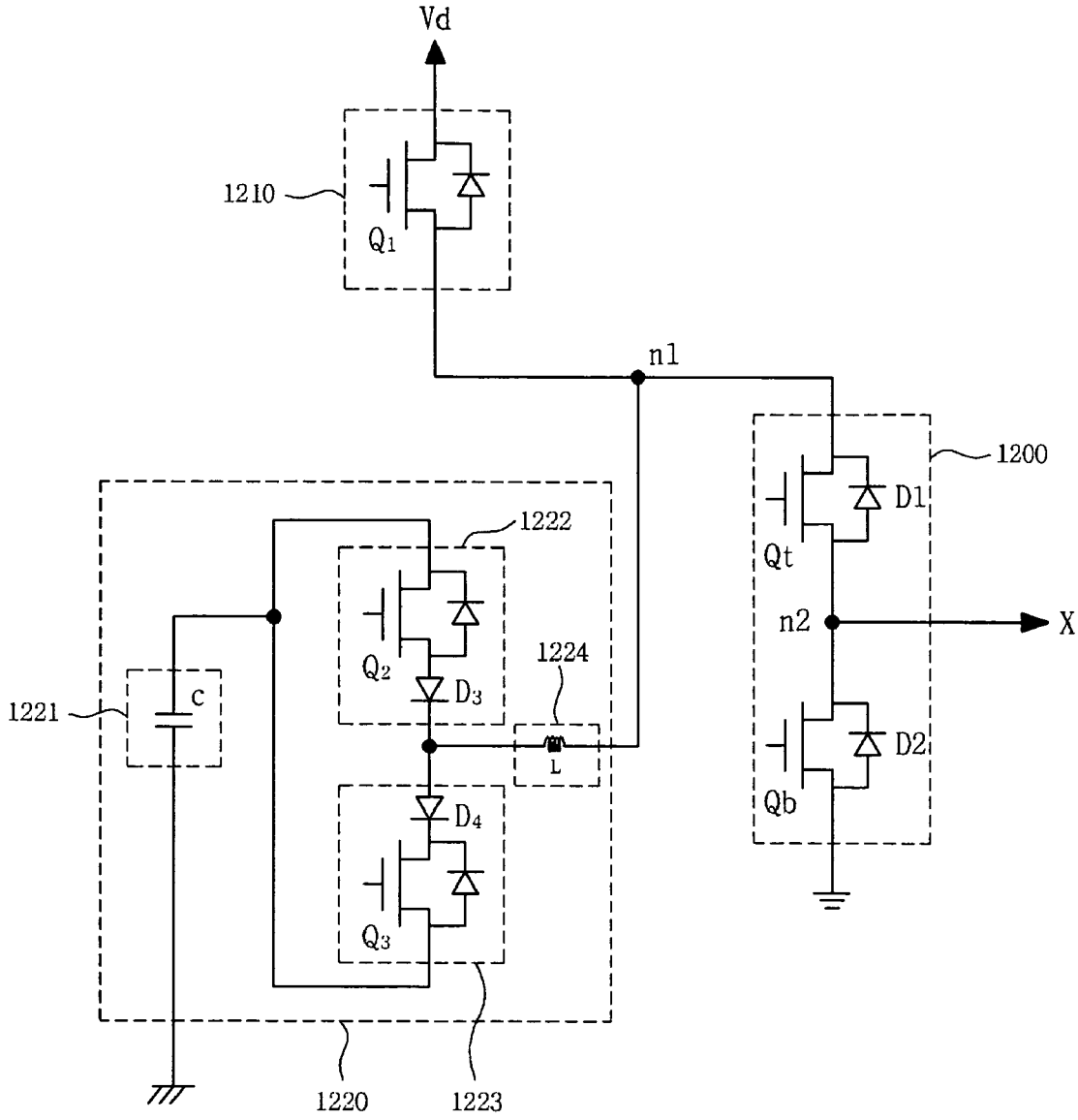
FIG. 14 illustrates a structure of the driver, preferably, the data driver of the plasma display apparatus according to the embodiment of the present invention.

FIG. 14 illustrates a structure of a driver, preferably, a data driver of the plasma display apparatus according to the embodiment of the present invention.

As shown in FIG. 14, the driver, preferably, the data driver of the plasma display apparatus according to the embodiment of the present invention comprises a data drive integrated circuit (IC) 1200, a data voltage supply controller 1210, and an energy recovery circuit 1220.

The data voltage supply controller 1210 comprises a data voltage supply control switch Q1. The data voltage supply controller 1210 supplies the data voltage Vd supplied from a data voltage source (not shown) to the data drive IC 1200.

The data drive IC 1200 is connected to the address electrode X of the plasma display panel. The data drive IC 1200 supplies a voltage supplied to the data drive IC 1200 to the address electrode X through a predeterminate switch.

It is preferable that the data drive IC 1200 is formed as one module independently of the data voltage supply controller 1210 and the energy recovery circuit 1220. For example, it is preferable that the data drive IC 1200 is formed in the form of one chip on a tape carrier package (TCP).

Moreover, it is preferable that the data drive IC 1200 comprises a top switch Qt and a bottom switch Qb.

One end of the top switch Qt is commonly connected to the data voltage supply controller 1210 and the energy recovery circuit 1220. The other end of the top switch Qt is connected to one end of the bottom switch Qb.

The other end of the bottom switch Qb is grounded. A second nod n2 between the other end of the top switch Qt and one end of the bottom switch Qb is connected to the address electrode X.

The energy recovery circuit 1220 comprises an energy storing unit 1221, an energy supply controller 1222, an energy recovery controller 1223 and an inductor unit 1224.

The energy storing unit 1221 comprises an energy storing capacitor C. The energy storing unit 1221 stores energy to be supplied to the address electrode X of the plasma display panel and stores unavailable energy recovered from the plasma display panel.

The energy supply controller 1222 comprises an energy supply control switch Q2. The energy supply controller 1222 forms a supply path of energy supplied from the energy storing capacitor C to the address electrode X of the plasma display panel.

One end of the energy supply controller 1222 is connected to the energy storing capacitor C.

It is preferable that the energy supply controller 1222 further comprises a reverse blocking diode D3 for preventing an inverse current from flowing in the energy storing unit 1221 through the energy supply control switch Q2.

The energy recovery controller 1223 comprises an energy recovery control switch Q3. The energy recovery controller 1223 forms a recovery path of energy recovered from the address electrode X of the plasma display panel to the energy storing capacitor C.

One end of the energy recovery controller 1223 is commonly connected to the energy storing capacitor C and the energy supply controller 1222.

It is preferable that the energy recovery controller 1223 further comprises a reverse blocking diode D4 for preventing an inverse current from flowing from the energy storing unit 1221 to the energy recovery control switch Q3.

Energy stored in the energy storing unit 1221 is supplied to the address electrode X of the plasma display panel through LC resonance of the inductor unit 1224. The unavailable energy of the plasma display panel is recovered to the energy storing unit 1221 through the LC resonance.

An operation of the driver, preferably, the data driver of FIG. 14 will be described with reference to FIGS. 15*a* through 15*c* and FIGS. 16*a* through 16*e*.

Figure 15A:
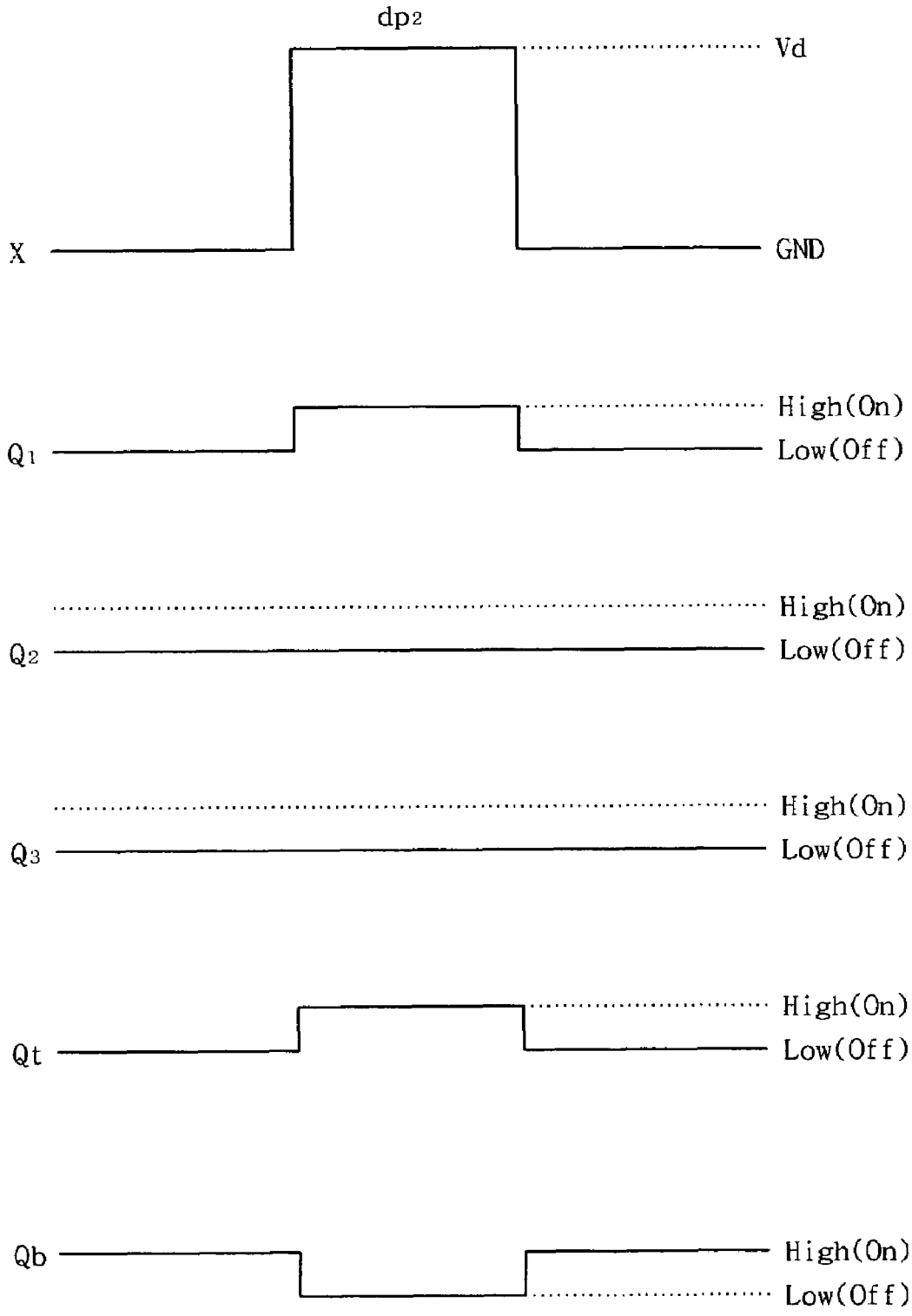
FIGS. 15*a* through 15*c* illustrate an operation of the driver of FIG. 14.
Figure 15B:
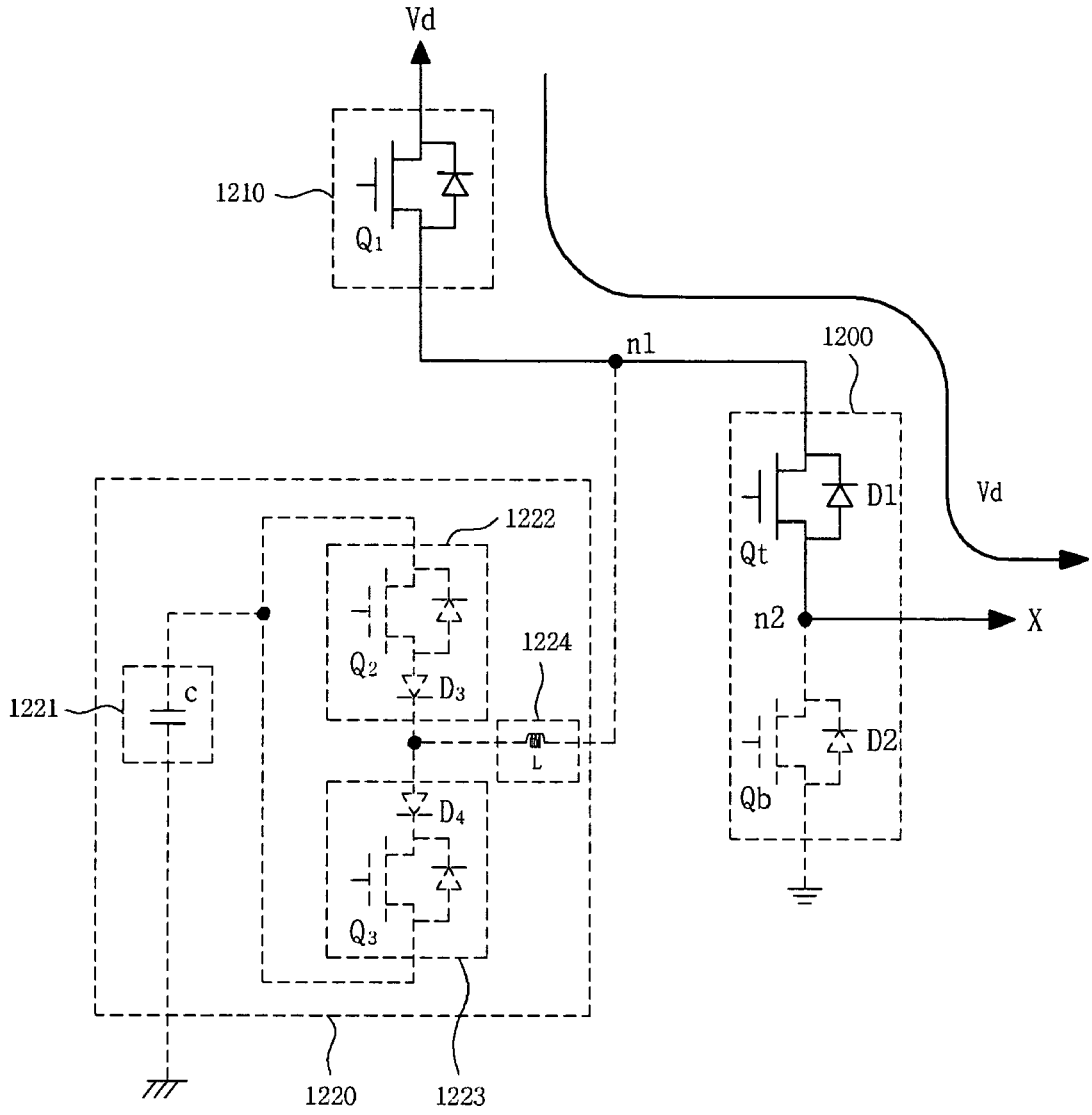
Figure 15C:
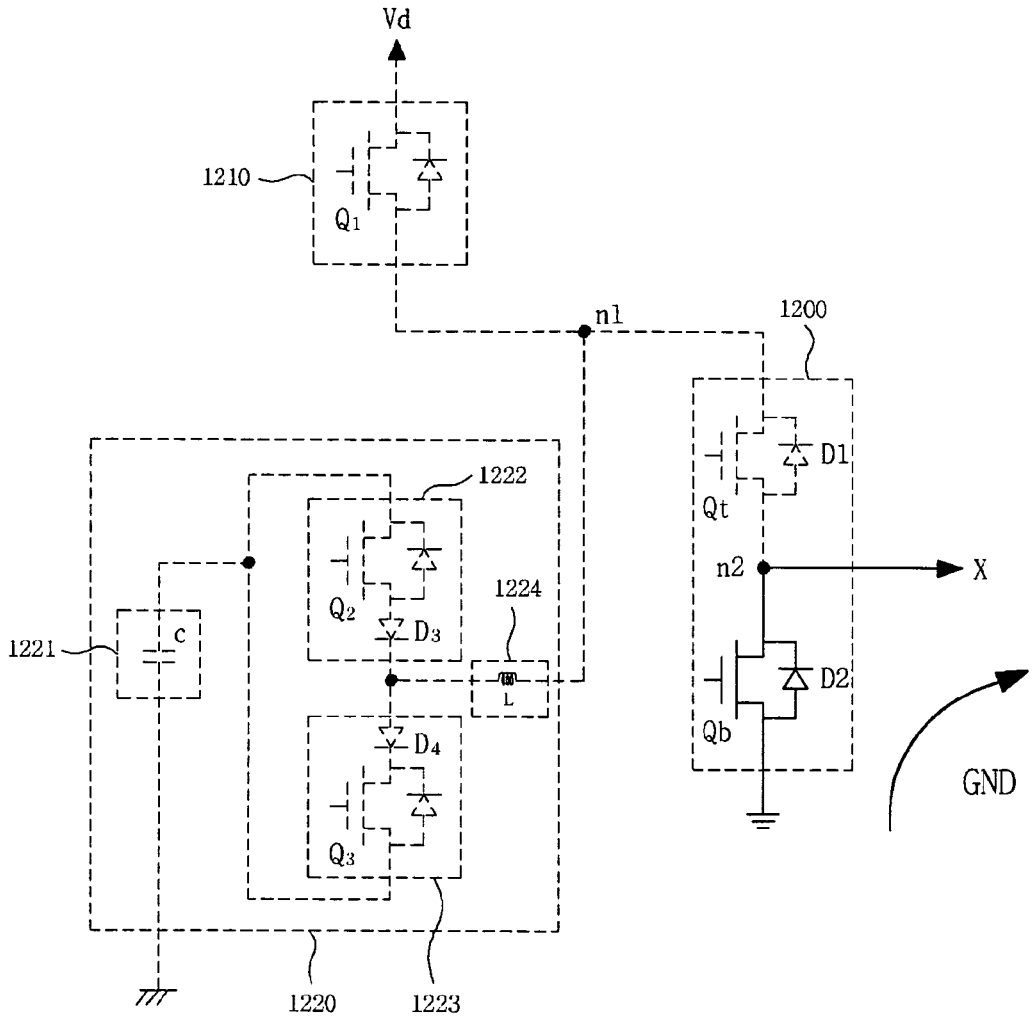

FIGS. 15*a* through 15*c* illustrate an operation of the driver of FIG. 14.

FIGS. 16*a* through 16*e* illustrate an operation of the driver of FIG. 14.

FIG. 15*a* shows switch timing of the driver, preferably, the data driver of FIG. 14 for generating a pulse of relatively shorter voltage rising period and/or relatively shorter voltage falling period than voltage rising period and/or voltage falling period of the remaining data pulses among the plurality data pulses, like the second data pulse dp2 of (b) of FIG. 7.

When the second data pulse dp2 is supplied to the address electrode X of the plasma display panel, the data voltage supply control switch Q1 of the data voltage supply controller 1210 and the top switch Qt of the data drive IC 1200 each are turned on and the energy supply control switch Q2 and the energy recovery control switch Q3 of the energy recovery circuit 1220 and the bottom switch Qb of the data drive IC 1200 each are turned off.

As shown in FIG. 15*b*, the data voltage Vd is supplied to the address electrode X of the plasma display panel through the data voltage supply control switch Q1 of the data voltage supply controller 1210, a first node n1, and the top switch Qt of the data drive IC 1200 in the order named.

After supplying the data voltage Vd to the address electrode X as shown in FIG. 15*b*, as shown in FIG. 15*c*, a ground level voltage GND is supplied to the address electrode X.

When the ground level voltage GND is supplied to the address electrode X after supplying the data voltage Vd to the address electrode X as described above, the bottom switch Qb of the data drive IC 1200 is turned on and the data voltage supply control switch Q1 of the data voltage supply controller 1210, the energy supply control switch Q2 and the energy recovery control switch Q3 of the energy recovery circuit 1220 and the top switch Qt of the data drive IC 1200 each are turned off.

As a result, as shown in FIG. 15*c*, the ground level voltage GND is supplied to the address electrode X of the plasma display panel through the bottom switch Qb of the data drive IC 1200.

The data pulse of relatively short voltage rising period and/or relatively short voltage falling period is supplied to the address electrode X of the plasma display panel by the above-described operations.

The voltage difference between the data pulse supplied to the address electrode X and a scan pulse synchronized with the data pulse and supplied to the scan electrode Y generates the address discharge during the address period.

Figure 16A:
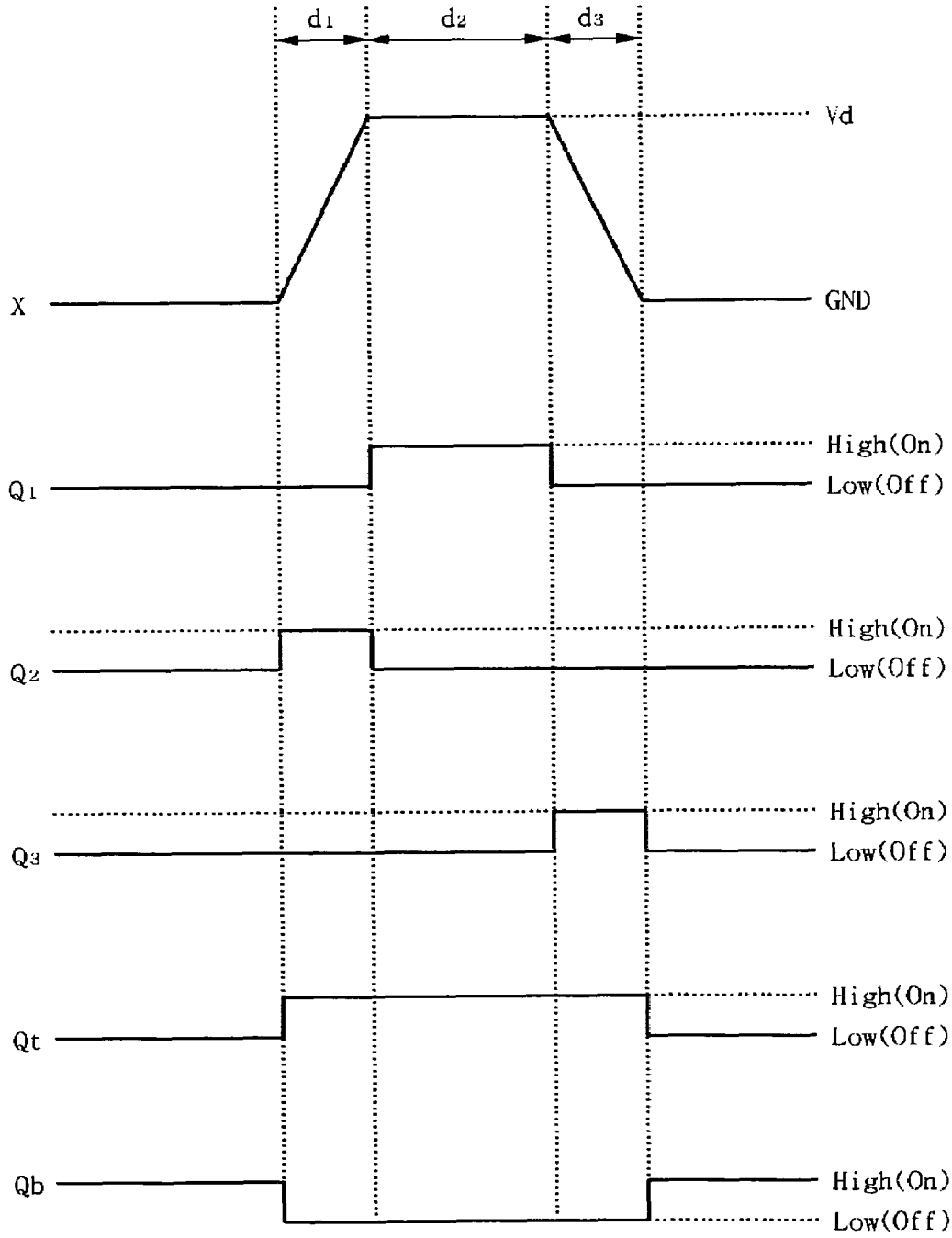
FIGS. 16*a* through 16*e* illustrate an operation of the driver of FIG. 14.

FIG. 16*a* shows switch timing of the driver, preferably, the data driver of FIG. 14 for generating a pulse of relatively longer voltage rising period and/or relatively longer voltage falling period than voltage rising period and/or voltage falling period of the remaining data pulses among the plurality data pulses, like the first data pulse dp1 of (a) of FIG. 7.

Figure 16B:
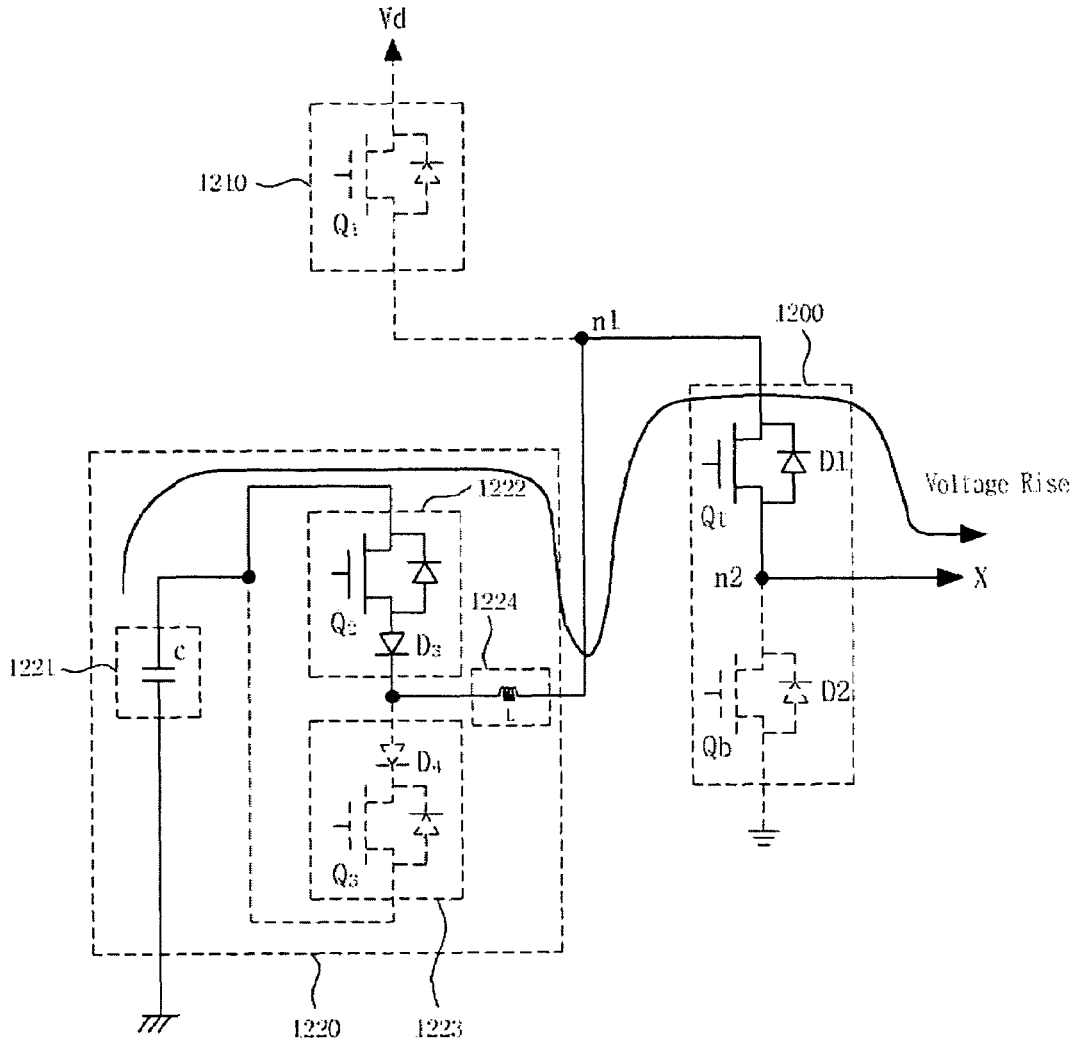

During a period d1 supplying the first data pulse dp1 to the address electrode X of the plasma display panel, as shown in FIG. 16*b*, the energy supply control switch Q2 of the energy supply controller 1222 of the energy recovery circuit 1220 and the top switch Qt of the data drive IC 1200 each are turned on.

Moreover, the energy recovery control switch Q3 of the energy recovery circuit 1220, the data voltage supply control switch Q1 of the data voltage supply controller 1210 and the bottom switch Qb of the data drive IC 1200 each are turned off.

As shown in FIG. 16*b*, the energy stored in the energy storing capacitor C of the energy storing unit 1221 is supplied to the address electrode X of the plasma display panel through the energy supply controller 1222, the inductor unit 1224 and the top switch Qt of the data drive IC 1200 in the order named.

A voltage of the energy supplied to the address electrode X of the plasma display panel gradually rises at a predetermined slope during the period d1 by LC resonance of the inductor unit 1224. In other words, the gradually rising voltage is supplied to the address electrode X.

After supplying the data voltage Vd to the address electrode X during the period d1, the data voltage Vd supplied to the address electrode X is maintained during a period d2.

When the data voltage Vd is supplied to the address electrode X during the period d2 as described above, the data voltage supply control switch Q1 of the data voltage supply controller 1210 and the top switch Qt of the data drive IC 1200 each are turned on. Further, the energy supply control switch Q2 and the energy recovery control switch Q3 of the energy recovery circuit 1220 and the bottom switch Qb of the data drive IC 1200 each are turned off.

Figure 16C:
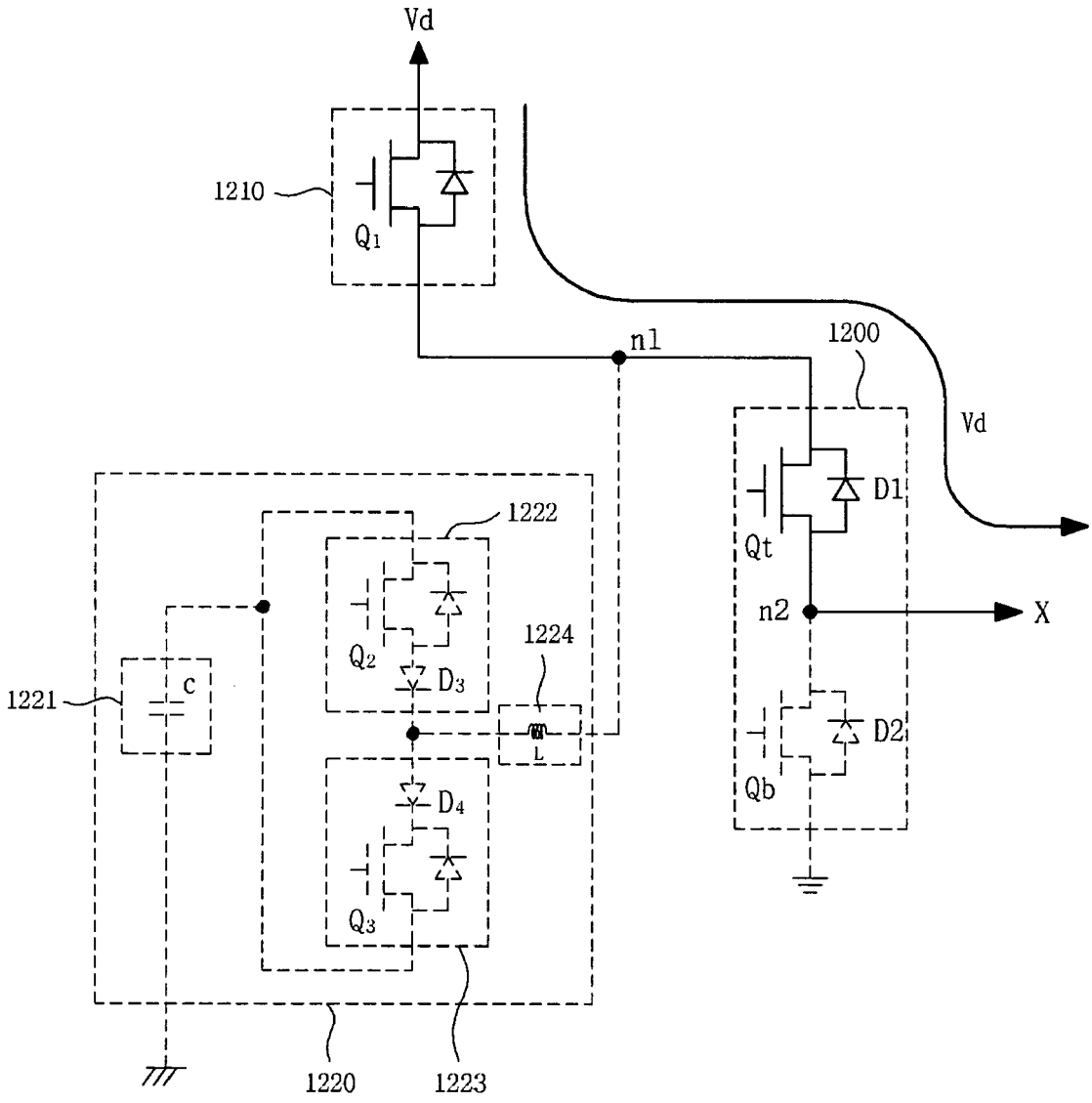

As a result, as shown in FIG. 16*c*, the data voltage Vd is supplied to the address electrode X of the plasma display panel through the data voltage supply control switch Q1 of the data voltage supply controller 1210, the first node n1 and the top switch Qt of the data drive IC 1200 in the order named.

After supplying the data voltage Vd to the address electrode X during the period d2, a gradually falling voltage is supplied to the address electrode X during a period d3.

Figure 16D:
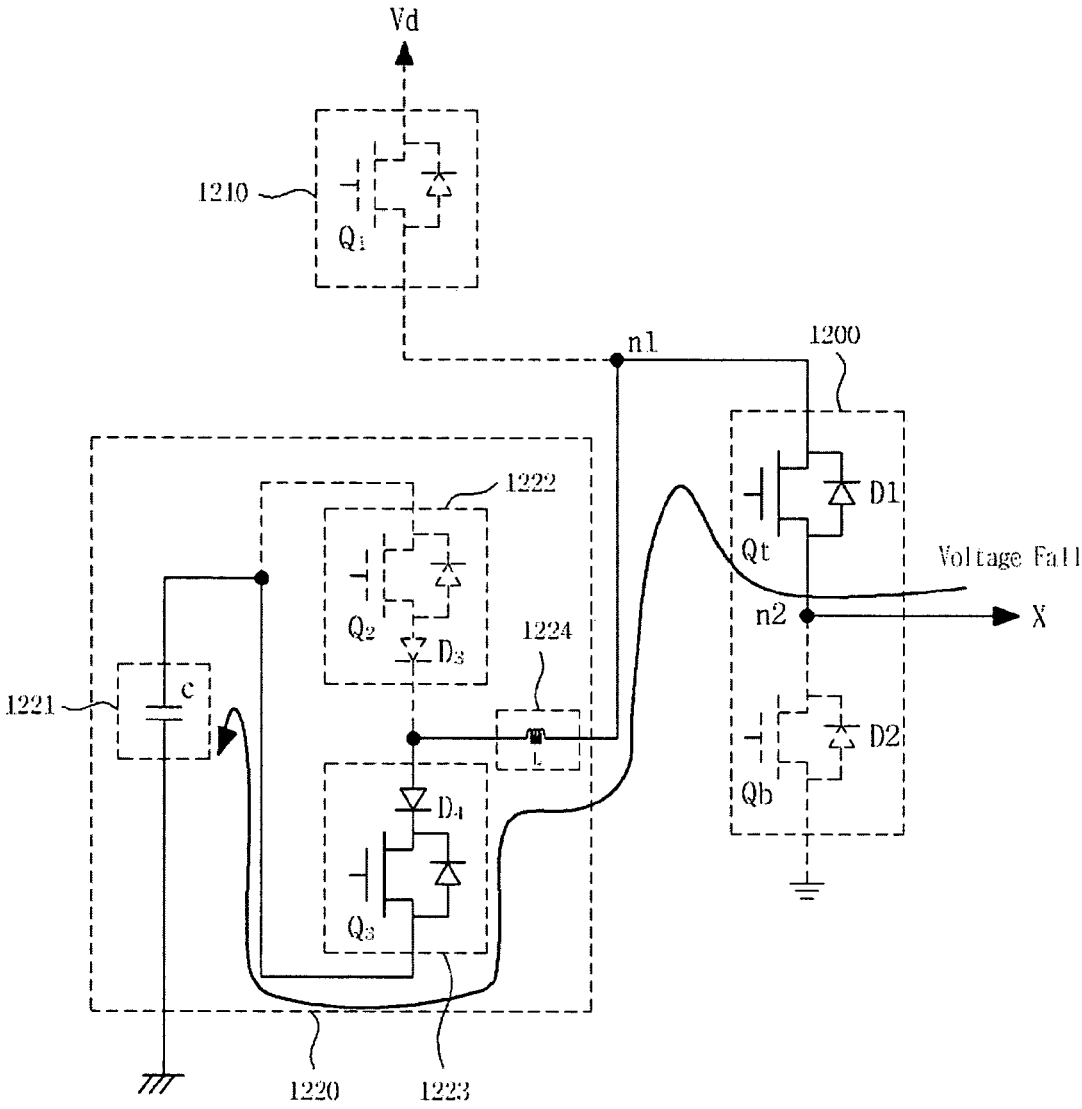

During the period d3 supplying the gradually falling voltage to the address electrode X of the plasma display panel, as shown in FIG. 16*d*, the energy recovery control switch Q3 of the energy recovery controller 1223 of the energy recovery circuit 1220 and the top switch Qt of the data drive IC 1200 each are turned on.

Moreover, the energy supply control switch Q2 of the energy recovery circuit 1220, the data voltage supply control switch Q1 of the data voltage supply controller 1210 and the bottom switch Qb of the data drive IC 1200 each are turned off.

As shown in FIG. 16*d*, the ineffective energy of the plasma display panel is recovered to the energy storing capacitor C of the energy storing unit 1221 through the top switch Qt of the data drive IC 1200, the inductor unit 1224 and the energy recovery controller 1223.

A voltage of the energy recovered from the address electrode X of the plasma display panel gradually falls at a predetermined slope during the period d3 by LC resonance of the inductor unit 1224. In other words, the gradually falling voltage is supplied to the address electrode X.

After supplying the data voltage Vd to the address electrode X as shown in FIG. 16*d*, a ground level voltage GND is supplied to the address electrode X as shown in FIG. 16*d*.

When the ground level voltage GND is supplied to the address electrode X, the bottom switch Qb of the data drive IC 1200 is turned on. Further, the data voltage supply control switch Q1 of the data voltage supply controller 1210, the energy supply control switch Q2 and the energy recovery control switch Q3 of the energy recovery circuit 1220 and the top switch Qt of the data drive IC 1200 each are turned off.

Figure 16E:
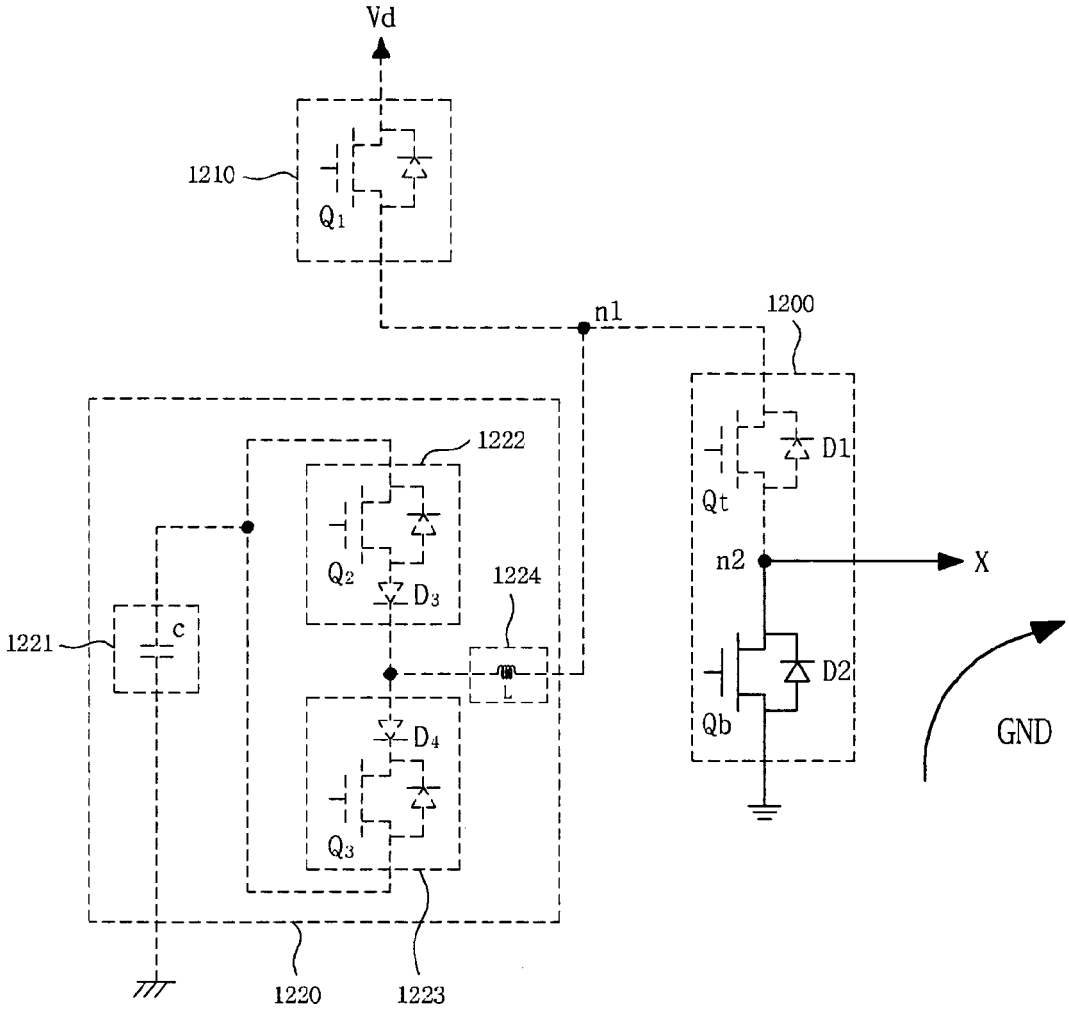

As a result, as shown in FIG. 16*e*, the ground level voltage GND is supplied to the address electrode X of the plasma display panel through the bottom switch Qb of the data drive IC 1200.

The data pulse of relatively long voltage rising period and/or relatively long voltage falling period is supplied to the address electrode X of the plasma display panel by the above-described operations.

The voltage difference between the data pulse supplied to the address electrode X and a scan pulse synchronized with the data pulse and supplied to the scan electrode Y generates the address discharge during the address period.

Figure 1:
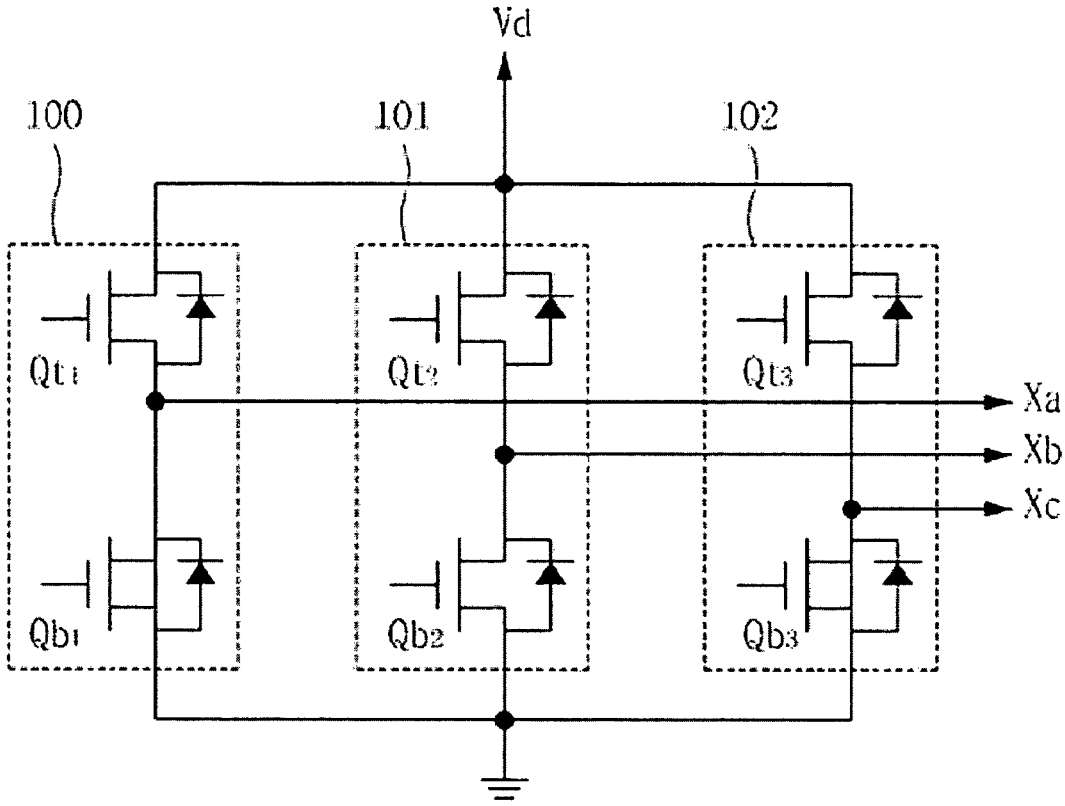
Fig. 1 Related art
FIG. 1 shows a structure of a plasma display apparatus comprising a related art data drive integrated circuit.
Figure 2:
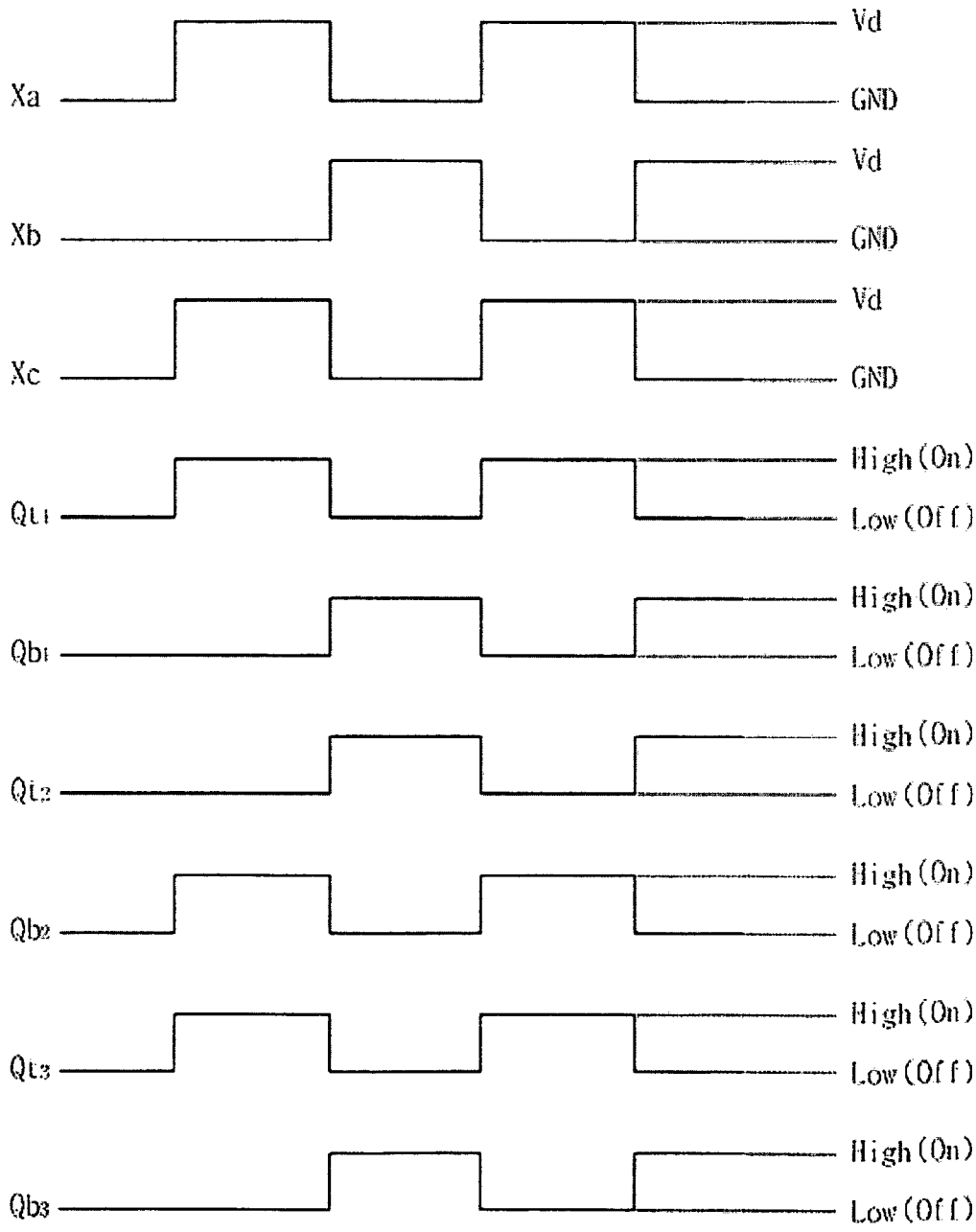
Fig. 2 Related art
FIG. 2 shows an operation timing for explaining an operation of the related art plasma display apparatus.

In the plasma display apparatus according to the embodiment of the present invention operated as described above, breakdown voltages of the switching elements, for example, the top switch Qt and the bottom switch Qb used in the data drive IC of FIG. 14 may be relatively less than breakdown voltages of the switching elements of the related art plasma display apparatus of FIG. 1.

For example, when the data pulse is supplied to the address electrode X as shown in FIGS. 15*a* through 15*c*, a current flowing in the top switch Qt of the data drive IC 1200 and a power consumed in the top switch Qt are approximately equal to the current and the power of the above Equation 1.

In other words, when the data voltage is 60 V, the top switch Qt of the data drive IC 1200 of FIGS. 15*a* through 15*c* consumes a power corresponding to (i×60 V). At this time, heat is generated in the top switch Qt in proportion to the consumption power W.

For example, when a resistance of the top switch Qt and a resistance of the data voltage supply control switch Q1 each are 30Ω, heat corresponding to [(60/30)×60=120 W] is generated in the top switch Qt.

Unlike FIGS. 15*a* through 15*c*, when the data pulse of the relatively long voltage rising period and/or the relatively long voltage falling period is supplied to the address electrode X as shown in FIGS. 16*a* through 16*e*, a current flowing in the top switch Qt of the data drive IC 1200 and a power consumed in the top switch Qt will be described.

When the data pulse of the relatively long voltage rising period and/or the relatively long voltage falling period is supplied to the address electrode X as shown in FIGS. 16*a* through 16*e*, the energy stored in the energy storing unit 1221 is supplied to the top switch Qt of the data drive IC 1200 through LC resonance of the inductor unit 1224.

As a result, when the data pulse of the relatively long voltage rising period and/or the relatively long voltage falling period is supplied, like the first data pulse dp1 of (a) of FIG. 7, most heat generated in the driver, preferably, the data driver is concentrated in the energy recovery circuit 1220 and an extremely small amount of heat is generated in the data drive IC 1200.

More specifically, since the energy stored in the energy storing unit 1221 is supplied to the top switch Qt of the data drive IC 1200 through the LC resonance of the inductor unit 1224 during the period d1 in FIG. 16*a*, most heat is generated in the energy supply control switch Q2 of the energy supply controller 1222 and the inductor unit 1224. Accordingly, an extremely small amount of heat is generated in the top switch Qt.

Since the difference between a voltage supplied from the energy recovery circuit 1220 to the top switch Qt through the LC resonance of the inductor unit 1224 and a voltage supplied from the data voltage supply controller 1210 to the top switch Qt is very small during the period d2 in FIG. 16*a*, changes in a voltage of the top switch Qt is very small. Accordingly, an amount of the current flowing in the top switch Qt during the period d2 is very small. As a result, the extremely small amount of heat is generated in the top switch Qt during the period d2.

Since the ineffective energy of the plasma display panel is recovered to the energy storing unit 1221 through the LC resonance of the inductor unit 1224 during the period d3 in FIG. 16*a*, most heat is generated in the energy recovery control switch Q3 of the energy recovery controller 1223 and the inductor unit 1224. Accordingly, the extremely small amount of heat is generated in the top switch Qt.

In short, when the data pulse like (a) of FIG. 7 is supplied to the address electrode X of the plasma display panel, heat generated in the driver, preferably, the data driver is not concentrated in a specific element and is dispersed.

For example, when the second data pulse dp2 of (b) of FIG. 7 is supplied, heat is generated in the top switch Qt of the data drive IC 1200.

On the other hand, when the first data pulse dp1 of (a) of FIG. 7 is supplied, most heat is generated in the energy recovery circuit 1220 and the extremely small amount of heat is generated in the top switch Qt of the data drive IC 1200.

Accordingly, when a data pulse of a pattern shown in FIG. 13 is supplied, the generation of heat in the top switch Qt of the data drive IC 1200 decreases by about 50% compared with the related art plasma display apparatus of FIG. 1.

In other words, heat generated in the data driver of the plasma display apparatus according to the embodiment of the present invention is dispersed in the data drive IC 1200, the energy recovery circuit 1220 and the data voltage supply controller 1210.

Accordingly, when driving the data driver of the plasma display apparatus according to the embodiment of the present invention, thermal damage of the switching element of the data driver, for example, the top switch Qt of the data drive IC 1200 is prevented. Not only the thermal damage of the top switch Qt but also the thermal damage of the bottom switch Qb are prevented.

In short, when the temperature of the driver, preferably, the data driver increases, heat generated in the data driver is dispersed more easily by increasing the supply number of data pulses of the relatively long voltage rising period and/or the relatively long voltage falling period.

The plurality of address electrodes is divided into a plurality of address electrode groups. It is possible to adjust voltage rising period and/or voltage falling period of the data pulse supplied to the plurality of address electrode groups.

Figure 17:
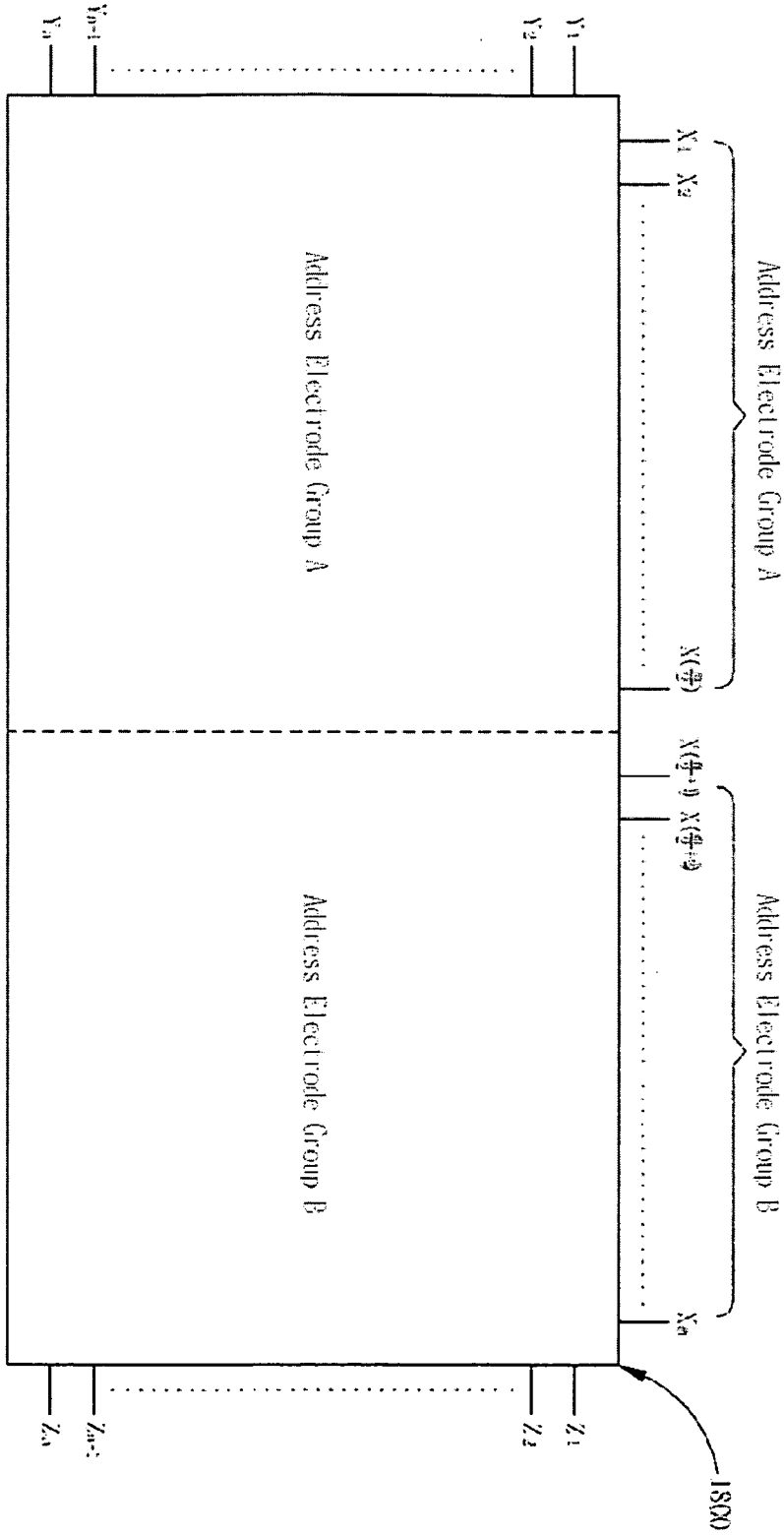
FIG. 17 illustrates a method of dividing a plurality of address electrodes of a plasma display panel into two address electrode groups.

FIG. 17 illustrates a method of dividing a plurality of address electrodes of a plasma display panel into two address electrode groups.

As shown in FIG. 17, a plurality of address electrodes X on a plasma display panel 1800 are divided into two address electrode groups A and B.

For example, when the number of address electrodes X on the plasma display panel 1800 is m, the address electrode group A includes a first address electrode to a m/2-th address electrode. The address electrode group B includes a (m/2)+1-th address electrode to a m-th address electrode.

The reason why the number of address electrode groups is set as two is that it is advantageous to divide the plasma display panel into two regions, for example, a left part and a right part in consideration of the manufacturing cost of the driving board.

In FIG. 17, the plurality of address electrodes X of the plasma display panel are divided two address electrode groups. However, the number of address electrode groups may be changed. Two or more address electrode groups will be described with reference to FIG. 18.

Figure 18:
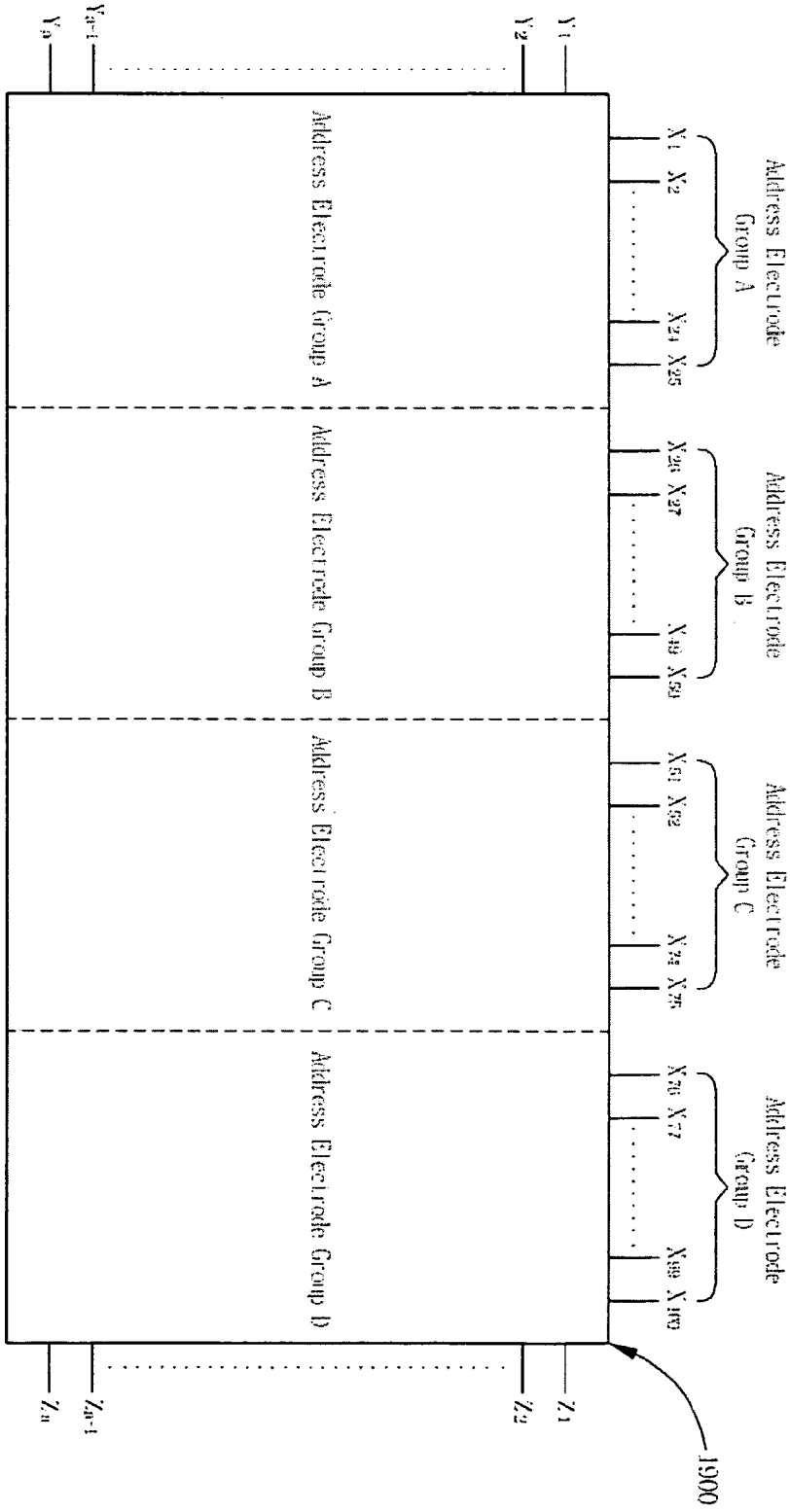
FIG. 18 illustrates a method of dividing a plurality of address electrodes of a plasma display panel into four address electrode groups.

FIG. 18 illustrates a method of dividing a plurality of address electrodes of a plasma display panel into four address electrode groups.

As shown in FIG. 18, a plurality of address electrodes X on a plasma display panel 1900 are divided into four address electrode groups A, B, C and D.

The number of address electrode groups is 2 or more and less than the total number of address electrodes. That is, when the total number of address electrodes is m and the total number of address electrode groups is N, a relationship between m and N may be represented by $2 \leqq N \leqq (m-1)$.

In FIG. 18, the address electrode groups A, B, c and D each have the same number of address electrodes. However, the number of address electrodes of some of the address electrode groups A, B, C and D may be different from the number of address electrodes of the remaining address electrode groups. The number of address electrode groups may be changed.

Figure 19:
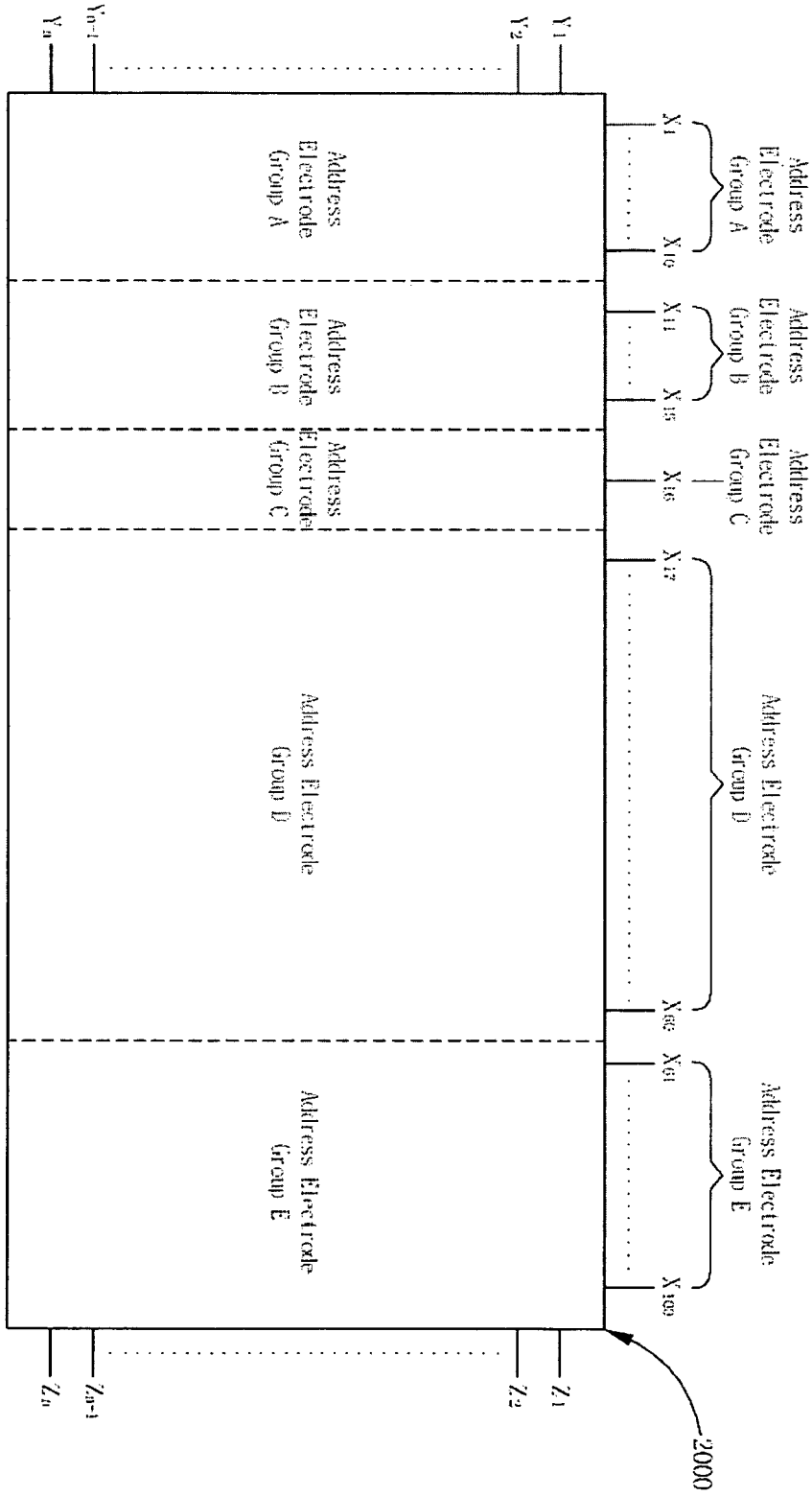
FIG. 19 illustrates a method of dividing a plurality of address electrodes of a plasma display panel into a plurality of address electrode groups, whose one or more includes the different number of address electrodes from the number of address electrodes of the remaining address electrode groups.

FIG. 19 illustrates a method of dividing a plurality of address electrodes of a plasma display panel into a plurality of address electrode groups, whose one or more include the different number of address electrodes from the number of address electrodes of the remaining address electrode groups.

As shown in FIG. 19, a plurality of address electrodes X on a plasma display panel 2000 are divided into five address electrode groups A, B, C, D and E.

The number of address electrodes of one or more of the address electrode groups A, B, C, D and E is different from the number of address electrodes of the remaining address electrode groups. In FIG. 19, the address electrode groups A, B, C, D and E each have the different number of address electrodes.

The address electrode group C includes only one address electrode, that is, a sixteenth address electrode X16. In other words, one address electrode forms one address electrode group.

As described above, the driving method of the plasma display apparatus, in which the address electrodes X of the plasma display panel are divided into the plurality of address electrode groups, for example, two address electrode groups as shown in FIG. 17, will be described with reference to FIG. 20.

Figure 20:
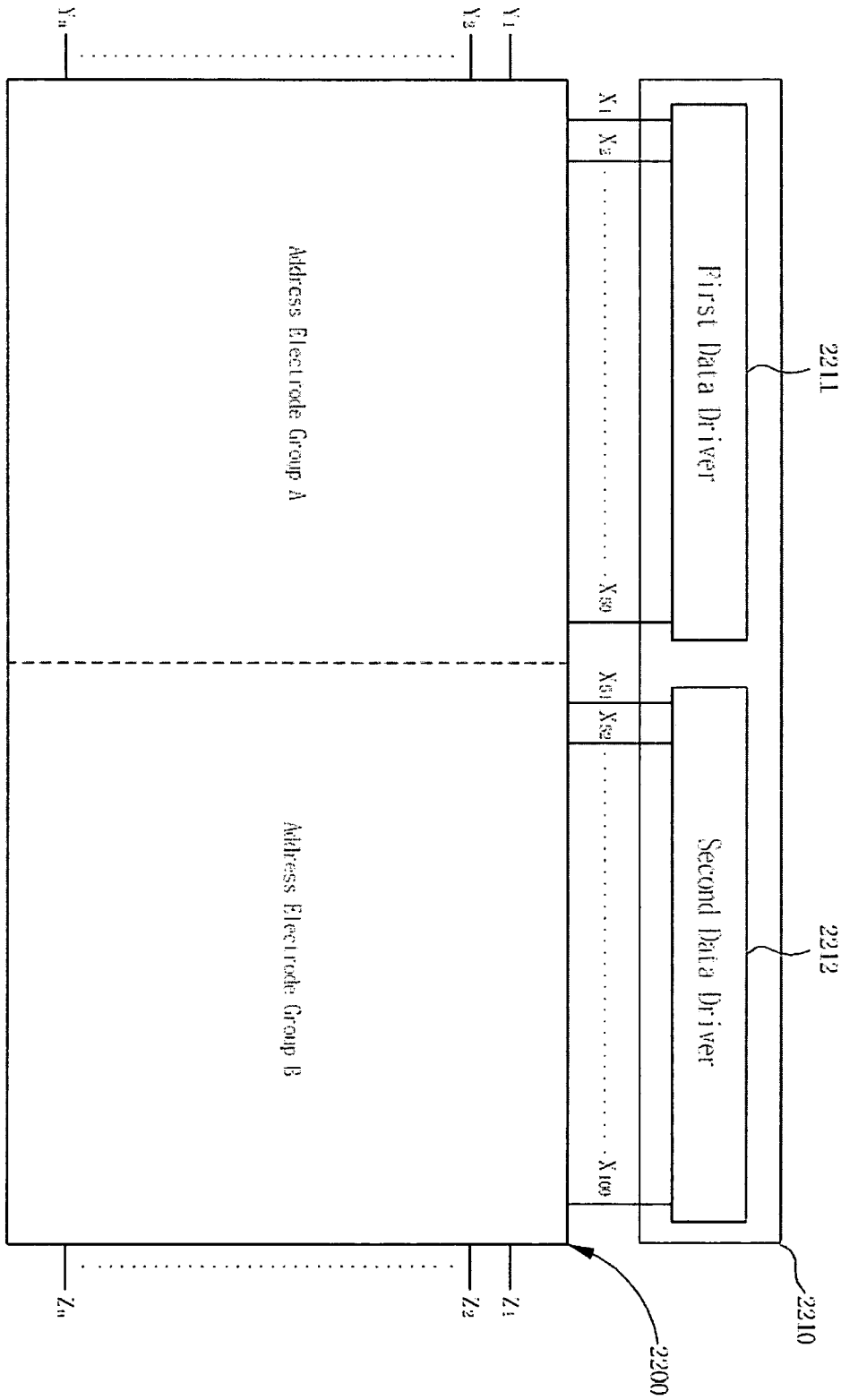
FIG. 20 illustrates a structure of a driver for supplying data pulses of different patterns to two address electrode groups.

FIG. 20 illustrates a structure of a driver for supplying data pulses of different patterns to two address electrode groups.

As shown in FIG. 20, when a plurality of address electrodes X on a plasma display panel 2200 are divided into two address electrode groups A and B, a driver 2210 of the plasma display apparatus according to the embodiment of the present invention comprises a first data driver 2211 for supplying a data pulse to the address electrode group A and a second data driver 2212 for supplying a data pulse to the address electrode group B.

The first and second data drivers 2211 and 2212 supply the data pulses of the different patterns to the address electrode groups A and B, respectively.

An operation of the plasma display apparatus according to the embodiment of the present invention, in which the plurality of address electrodes are divided into two address electrode groups, will be described with reference to FIG. 21.

Figure 21:
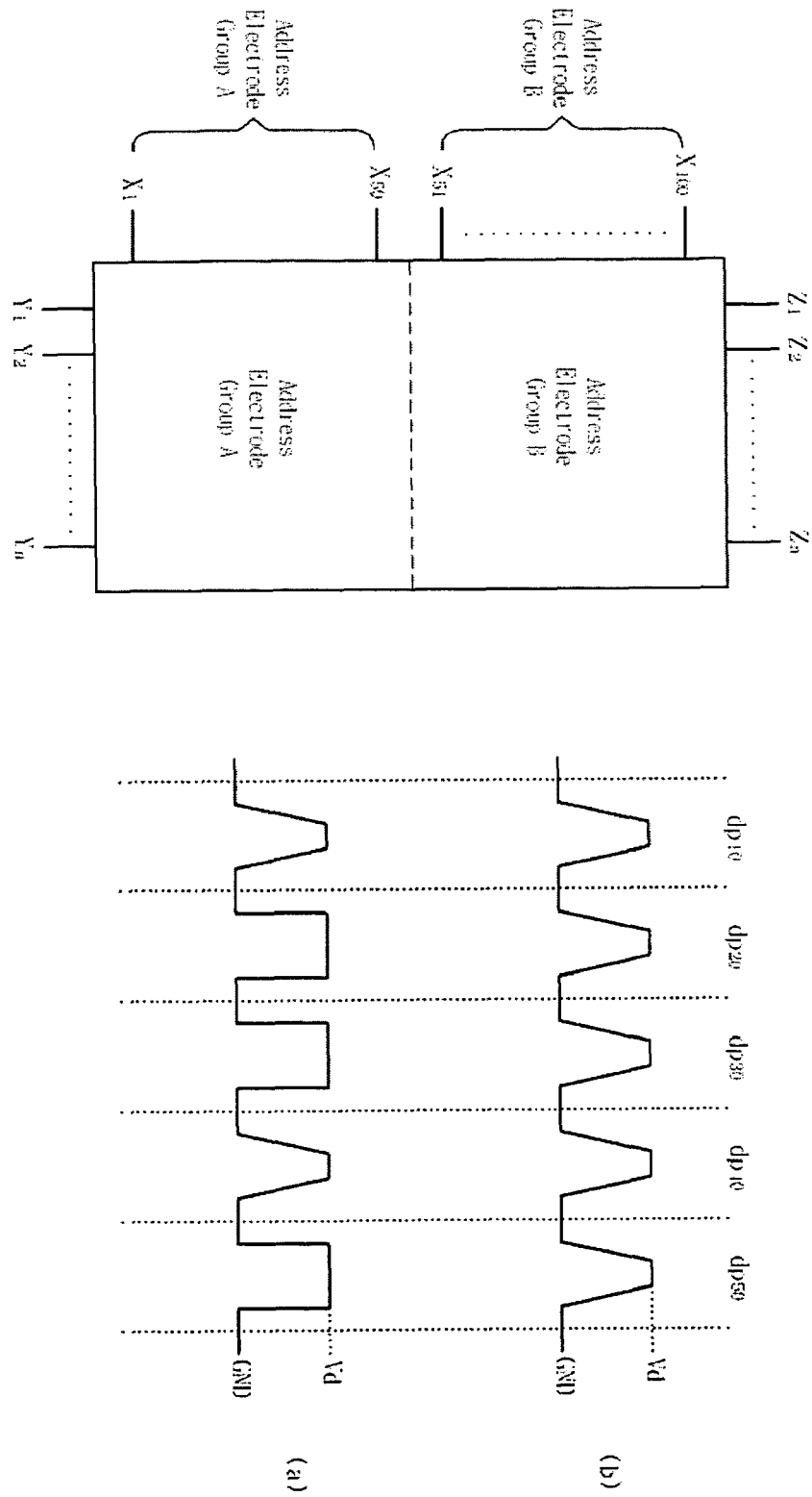
FIG. 21 illustrates an operation of the plasma display apparatus according to the embodiment of the present invention, in which a plurality of address electrodes are divided into two address electrode groups.

FIG. 21 illustrates an operation of the plasma display apparatus according to the embodiment of the present invention in which a plurality of address electrodes are divided into two address electrode groups.

FIG. 21 shows a data pulse supplied to each of two address electrode groups A and B when a plurality of address electrodes X are divided into two address electrode groups A and B and first and second data drivers for supplying the data pulse to each of the address electrode groups A and B are formed.

When the temperature of the driver, preferably, the data driver is relatively high and equal to or more than the first temperature, one or more data pulses of relatively long voltage rising period and/or relatively long voltage falling period are supplied to at least one of the plurality of address electrode groups including one or more address electrodes X.

Suppose that a temperature of the first data driver 2211 of FIG. 20 for supplying a data pulse of a pattern of (a) of FIG. 21 to the address electrode group A is lower than a temperature of the second data driver 2212 of FIG. 20 for supplying a data pulse of a pattern of (b) of FIG. 21 to the address electrode group B.

For example, as shown in (a) of FIG. 21, a tenth data pulse dp10, a twentieth data pulse dp20, a thirtieth data pulse dp30, a fortieth data pulse dp40 and a fiftieth data pulse dp50 are supplied to the address electrode group A including a first address electrode X1 to a fiftieth address electrode X50. The voltage rising period and/or the voltage falling period of the tenth data pulse dp10 and the fortieth data pulse dp40 is relatively longer than the voltage rising period and/or the voltage falling period of the twentieth data pulse dp20, the thirtieth data pulse dp30 and the fiftieth data pulse dp50.

Further, as shown in (b) of FIG. 21, a tenth data pulse dp10, a twentieth data pulse dp20, a thirtieth data pulse dp30, a fortieth data pulse dp40 and a fiftieth data pulse dp50 are sequentially supplied to the address electrode group B including a fifty first address electrode X51 to a hundredth address electrode X100. The voltage rising period and/or the voltage falling period of the data pulses dp10, dp20, dp30, dp40 and dp50 supplied to the address electrode group B is relatively longer than the voltage rising period and/or the voltage falling period of the data pulses dp10, dp20, dp30, dp40 and dp50 supplied to the address electrode group A.

Accordingly, the number of data pulses of the relatively long voltage rising period and/or the relatively long voltage falling period among the plurality of data pulses supplied from the second data driver 2212, whose the temperature is higher than the temperature of the first data driver 2211, is more than the number of data pulses of the relatively long voltage rising period and/or the relatively long voltage falling period among the plurality of data pulses supplied from the first data driver 2211.

Figure 22:
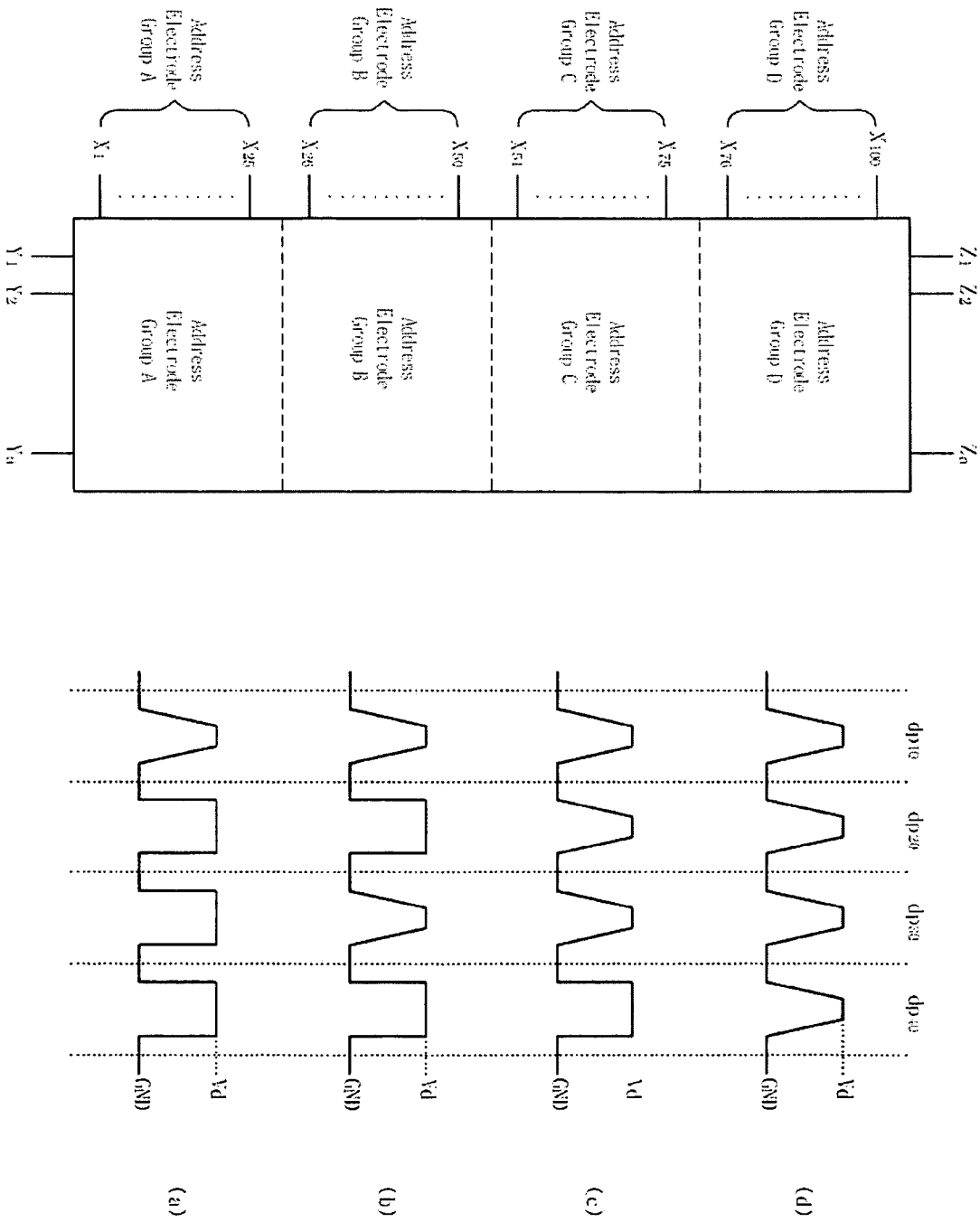
FIG. 22 illustrates an operation of the plasma display apparatus according to the embodiment of the present invention, in which a plurality of address electrodes are divided into three or more address electrode groups.

FIG. 22 illustrates an operation of the plasma display apparatus according to the embodiment of the present invention, in which a plurality of address electrodes are divided into three or more address electrode groups.

FIG. 22 shows a data pulse supplied to each of address electrode groups when a plurality of address electrodes X are divided into three or more address electrode groups, for example, four address electrode groups A, B, C and D as shown in FIG. 18.

When the plurality of address electrodes X on the plasma display panel are divided into four address electrode groups A, B, C and D as described above, the plasma display apparatus may comprise four data drivers (not shown) for supplying a data pulse to each of four address electrode groups A, B, C and D. Since the data drivers for supplying the data pulse to each of the plurality of address electrode groups are described with reference to FIG. 20, a description thereof is omitted.

When the temperature of the driver, preferably, the data driver is relatively high and equal to or more than the first temperature, one or more data pulses of relatively long voltage rising period and/or relatively long voltage falling period are supplied to at least one of the plurality of address electrode groups including one or more address electrodes X.

As described above, the energy recovery circuit is added to the driver, preferably, the data driver for supplying the data pulse in the plasma display apparatus according to the embodiment of the present invention. Accordingly, heat generated by driving the plasma display apparatus is prevented being concentrated in the specific element, preferably, the data drive IC. Further, thermal and electrical damage of the data drive IC is prevented so that operation stability of the plasma display apparatus is improved.

It will be apparent to those skilled in the art that various modifications and variation can be made in the present invention without departing from the spirit or scope of the invention. Thus, it is intended that the present invention cover the modifications and variations of this invention provided they come within the scope of the appended claims and their equivalents.

What is claimed is:

1. A plasma display apparatus comprising:

a plasma display panel comprising an address electrode; and a driver for supplying a first data pulse to the address electrode when a temperature of the plasma display panel or an ambient temperature of the plasma display panel is lower than a first temperature, wherein the driver is adapted to supply a second data pulse to the address electrode when the temperature of the plasma display panel or the ambient temperature of the plasma display panel is equal to or greater than the first temperature, wherein each of the first data pulse and the second data pulse includes three consecutive line segments corresponding to a voltage rising period, a peak level period, and a voltage falling period, and wherein the voltage rising period of the second data pulse is longer than the voltage rising period of the first data pulse.

2. The plasma display apparatus of claim 1, wherein the first data pulse and the second data pulse are applied in a subfield.

3. The plasma display apparatus of claim 1, wherein the voltage falling period of the second data pulse is longer than the voltage falling period of the first data pulse.

4. The plasma display apparatus of claim 3, wherein the voltage rising period is a transition time between 10% and 90% levels of a total voltage increase of a data pulse, and the voltage falling period is a transition time between 90% and 10% levels of a total decrease of a data pulse.

5. The plasma display apparatus of claim 1, wherein the voltage rising period and/or the voltage falling period of the first data pulse or the second data pulse ranges from 500 ns to 1,000 ns.

6. The plasma display apparatus of claim 1, wherein the driver includes an energy recovery circuit that has an LG circuit for supplying the second data pulse.

7. The plasma display apparatus of claim 1, wherein a slope of the line segment corresponding to the voltage rising period of the second data pulse is different from an absolute value of a slope of the line segment corresponding to the voltage falling period of the second data pulse.

8. A plasma display apparatus comprising:

a plasma display panel comprising an address electrode;

a data driver for supplying a first data pulse to the address electrode; and an energy recovery circuit for supplying a second data pulse to the address electrode depending on a temperature of the plasma display panel or an ambient temperature of the plasma display panel, wherein each of the first data pulse and the second data pulse includes three consecutive line segments corresponding to a voltage rising period, a peak level period, and a voltage falling period, and wherein the voltage rising period of the second data pulse is longer than the voltage rising period of the first data pulse.

9. The plasma display apparatus of claim 8, wherein the data driver supplies the first data pulse to the address electrode when the temperature of the plasma display panel or the ambient temperature of the plasma display panel is lower than a first temperature.

10. The plasma display apparatus of claim 9, wherein the energy recovery circuit supplies the second data pulse when the temperature of the plasma display panel or the ambient temperature of the plasma display panel is equal to or greater than the first temperature.

11. The plasma display apparatus of claim 10, wherein the voltage falling period of the second data pulse is longer than the voltage falling period of the first data pulse.

12. The plasma display apparatus of claim 11, wherein the voltage rising period is a transition time between 10% and 90% levels of a total voltage increase of a data pulse, and the voltage falling period is a transition time between 90% and 10% levels of a total voltage decrease of a data pulse.

13. The plasma display apparatus of claim 11, wherein the voltage rising period and/or the voltage falling period of the first data pulse or the second data pulse ranges from 500 ns to 1,000 ns.

14. The plasma display apparatus of claim 8, wherein the energy recovery circuit includes an LC circuit.

15. The plasma display apparatus of claim 8, wherein a slope of the line segment corresponding to the voltage rising period of the second data pulse is different from an absolute value of a slope of the line segment corresponding to the voltage falling period of the second data pulse.

16. A method of driving a plasma display apparatus having a plasma display panel, comprising:

supplying a first data pulse to an address electrode of the plasma display panel when a temperature of the plasma display panel or an ambient temperature of the plasma display panel is lower than a first temperature; and supplying a second data pulse to the address electrode when the temperature of the plasma display panel or the ambient temperature of the plasma display panel is equal to or greater than the first temperature, wherein each of the first data pulse and the second data pulse includes three consecutive line segments corresponding to a voltage rising period, a peak level period, and a voltage falling period, and wherein the voltage rising period of the second data pulse is longer than the voltage rising period of the first data pulse.

17. The method of claim 16, wherein the first data pulse and the second data pulse are applied in a subfield.

18. The method of claim 12, wherein the voltage falling period of the second data pulse is longer than the voltage falling period of the first data pulse.

19. The method of claim 18, wherein the voltage rising period is a transition time between 10% and 90% levels of a total voltage increase of a data pulse, and the voltage falling period is a transition time between 90% and 10% levels of a total voltage decrease of a data pulse.

20. The method of claim 16, wherein the voltage rising period and/or the voltage falling period of the first data pulse or the second data pulse ranges from 500 ns to 1,000 ns.

21. The method of claim 16, wherein supplying the second data pulse is performed by an energy recovery circuit having an LC circuit.

22. The method of claim 16, wherein a slope of the line segment corresponding to the voltage rising period of the second data pulse is different from an absolute value of a slope of the line segment corresponding to the voltage falling period of the second data pulse.

23. A plasma display panel, comprising:

a plurality of address electrode groups, each of the plurality of address electrode groups including at least one address electrode; and a plurality of data drivers, each of the plurality of data drivers being configured to provide a sequence of data pulses to a corresponding one of the plurality of address electrode groups, each of the data pulses being one of a first data pulse and a second data pulse, wherein each of the first data pulse and the second data pulse includes three consecutive line segments corresponding to a voltage rising period, a peak level period, and a voltage falling period, and wherein the voltage rising period of the second data pulse is different from the voltage rising period of the first data pulse.

24. The plasma display panel of claim 23, wherein a total number of the first data pulses in a sequence is determined by a temperature of a corresponding one of the plurality of data drivers.

25. The plasma display panel of claim 23, wherein the voltage falling period of the second data pulse is different from the voltage falling period of the first data pulse.

26. The plasma display panel of claim 23, wherein a slope of the line segment corresponding to the voltage rising period of the second data pulse is different from an absolute value of a slope of the line segment corresponding to the voltage falling period of the second data pulse.

* * * * *